US011098973B2

(12) United States Patent
Walthert

(10) Patent No.: US 11,098,973 B2
(45) Date of Patent: Aug. 24, 2021

(54) CROSSBOW

(71) Applicant: Crosman Corporation, Bloomfield, NY (US)

(72) Inventor: Hans J. Walthert, Rush, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 16/503,460

(22) Filed: Jul. 3, 2019

(65) Prior Publication Data

US 2020/0011634 A1 Jan. 9, 2020

Related U.S. Application Data

(60) Provisional application No. 62/693,744, filed on Jul. 3, 2018.

(51) Int. Cl.
*F41B 5/12* (2006.01)
*F41B 5/10* (2006.01)

(52) U.S. Cl.
CPC ..... *F41B 5/123* (2013.01); *F41B 5/105* (2013.01)

(58) Field of Classification Search
CPC .. F41B 5/12; F41B 5/123; F41B 5/105; F41B 5/0094
USPC ..... 124/25, 25.6, 900
See application file for complete search history.

(56) References Cited

U.S. PATENT DOCUMENTS 4,887,582 A * 12/1989 Chattin ..... F41B 5/10 124/25.6
7,578,289 B2 * 8/2009 Norkus ..... F41B 5/0094 124/25
7,637,256 B2 * 12/2009 Lee ..... F41B 5/10 124/25.6
7,823,572 B2 * 11/2010 Anderson ..... F41B 5/1469 124/25
8,191,541 B2 * 6/2012 Shaffer ..... F41B 5/123 124/25
8,833,349 B2 * 9/2014 Park ..... F41B 5/10 124/25.6
8,893,694 B1 * 11/2014 DeBole ..... F41B 5/10 124/25.6
8,997,728 B2 * 4/2015 Popov ..... F41B 5/1469 124/25.6
9,086,249 B2 * 7/2015 Peacemaker ..... F41B 5/10
9,297,604 B1 * 3/2016 Sidebottom ..... F41B 5/12
9,377,267 B1 * 6/2016 Kempf ..... F41B 5/123
9,513,080 B1 * 12/2016 Kempf ..... F41B 5/1411
(Continued)

*Primary Examiner* — Alexander R Niconovich
(74) *Attorney, Agent, or Firm* — Lee & Hayes, P.C.

(57) ABSTRACT

Crossbows are provided having a barrel with one limb and one winding system mounted to each of two opposite sides of the barrel. Each winding system has a limb string connected to one of the limbs and a limb cam about which the limb string can be wound. The limb cams are connected to and positioned apart from arrow string cams by respective interconnects and an arrow string extends across the barrel from an arrow string cam on one side of the barrel to an arrow string cam on the other side of the barrel. The limbs provide first forces urging the limb strings to unwind from the limb cams and the interconnects receive the first forces and convey a second forces to the arrow cams urging the arrow cams to rotate so as to wind the arrow strings onto the arrow cams. The arrow string is drawn against such urging.

20 Claims, 29 Drawing Sheets

(56) References Cited

U.S. PATENT DOCUMENTS

| | | | | |
|---|---|---|---|---|
| 9,528,788 | B2 * | 12/2016 | McPherson | F41B 5/105 |
| 9,759,509 | B1 * | 9/2017 | Kempf | F41B 5/123 |
| 9,829,268 | B1 * | 11/2017 | Kempf | F41B 5/123 |
| 9,879,938 | B1 * | 1/2018 | Isenhower | F41B 5/123 |
| 9,945,634 | B1 * | 4/2018 | Isenhower | F41B 5/10 |
| 10,018,442 | B1 * | 7/2018 | Kempf | F41B 5/123 |
| 10,190,841 | B2 * | 1/2019 | Laurence | F41B 5/123 |
| 10,209,026 | B2 * | 2/2019 | Yehle | F41B 5/066 |
| 10,393,470 | B1 * | 8/2019 | Popov | F41B 5/105 |
| 10,473,417 | B1 * | 11/2019 | Peacemaker | F41B 5/105 |
| 10,514,226 | B2 * | 12/2019 | Shaffer | F41B 5/1449 |
| 10,520,274 | B2 * | 12/2019 | Bartels | F41B 5/123 |
| 10,533,822 | B1 * | 1/2020 | Popov | F41B 5/123 |
| 2010/0000504 | A1 * | 1/2010 | Trpkovski | F41B 5/10<br>124/25.6 |
| 2010/0206284 | A1 * | 8/2010 | Popov | F41B 5/105<br>124/88 |
| 2011/0041820 | A1 * | 2/2011 | Stanziale | F41B 5/123<br>124/25 |
| 2012/0125302 | A1 * | 5/2012 | Stanziale | F41B 5/123<br>124/25 |
| 2017/0115088 | A1 * | 4/2017 | Grace | F41B 5/105 |
| 2018/0202748 | A1 * | 7/2018 | Shaffer | F41B 5/123 |
| 2019/0301829 | A1 * | 10/2019 | Shaffer | F41B 5/123 |

* cited by examiner

CROSSBOW

CROSS REFERENCE TO RELATED APPLICATIONS

This application claims the benefit of U.S. Provisional Application No. 62/693,744 filed Jul. 3, 2018.

STATEMENT REGARDING FEDERALLY SPONSORED RESEARCH OR DEVELOPMENT

N/A.

FIELD OF THE INVENTION

Crossbows having a narrow width.

DESCRIPTION OF RELATED ART

Crossbows typically include a bow, a barrel and a firing system. In general the bow is mounted closer to one end of the barrel while the firing system is mounted closer to the other. The bow has limbs with central ends mounted to a riser and distal ends on opposite sides of the crossbow and a string is mounted between the distal ends and crosses the barrel To cock the crossbow, the string is drawn from the rest position to a cocked position where it is held by the firing system. This bends the limbs storing potential energy in the limbs. The firing system holds the bowstring in the cocked position until a user activates a trigger. When the trigger is activated the potential energy in the limbs is converted into kinetic energy that drives the string and arrow along the barrel to fire the arrow.

Many crossbows have limbs that extend for significant distances away from the barrel of the crossbow. This can lead to challenges in transporting, storing and using high performance crossbows—particularly when in difficult terrain and in the field.

Thus, there can be advantages to narrow crossbow designs and there have been efforts to provide such designs to the market. For example, U.S. Pat. No. 8,191,541 and others in this family of patents claim crossbows having certain geometric configurations and describes the use of particular limb configurations to accomplish this.

Crossbow designs such as that shown in the '541 patent require complex limb designs to achieve narrowness, but also require the presence of wheels or cams mounted at the free ends of each limb. This in turn requires a wheel and wheel mounting to the free ends of each limb that are capable of withstanding the highest loads of the bowstring, the shock and vibration experienced when the bowstring is released and limb ends snap outwardly, and any and all incidental contact to which the wheels are exposed as a direct and proximate result of being positioned at the extreme lateral edges of the bow. For example in the bows of the '541 family the wheels extend at least in part outward of the limbs of the bow with no protection against incidental contact. This imposes additional challenges on the design of the limbs themselves as the limbs must be adapted to store potential energy and to rapidly release this potential energy to fire the crossbow while also being adapted to support a mass proximate the free ends thereof without damage or variation in wheel position despite exposure to significant static and dynamic forces during both the drawing and firing of the crossbow.

Some have offered a partial solution to these problems by providing a crossbow with wheels that are positioned fully within the outer boundaries of limbs. For example, crossbows such as the CAMX A4 sold by CAMX Outdoors, LLC., Kent, Ohio, USA and the Demon crossbow sold by Barnet Crossbows, Tarpon Springs, Fla., USA each provided cams having mounts that are joined to and extend from an interior surface of the limbs toward the barrel of the crossbow. Cams or wheels can be attached to the limbs by way of the mountings such that the mountings and wheels are outside of or within an outer envelope defined by the limbs. This however creates challenges in crossbow limb design in that additional mass is added to the free ends of the limbs and in that the mass of the cams or wheels and the mass of the mountings is imbalanced relative to the limb.

One of the challenges also created is the imbalance of cam or wheel loading relative to a central plane of rotation of the wheel. This arises when a crossbow is drawn or when a desired draw cycle output produces let off.

It will be appreciated that it can be difficult to provide a crossbow system with narrow width and high power using the current design paradigms. What is needed therefore is a crossbow with an improved design, performance and reduce complexity.

BRIEF SUMMARY OF THE INVENTION

Crossbows are provided. In embodiments, crossbows may have a barrel, a fire control system, and a bow system with the bow system having a riser positioning a first limb on a first side of a barrel and a second limb on a second side of the barrel, a first winding system joined to a first side of the barrel having a first limb string linked to a free end of the first limb and to a rotatable first limb string winder about which the first limb string can be wound, a rotatable first arrow string winder about which a first portion of an arrow string can be wound and a first interconnect separates the first limb string winder from the first arrow string winder, and transferring at least a portion of a first force urging rotation of the first limb string winder to urge rotation of the first arrow string winder. A second winding system is joined to a second side of the barrel having a second limb string linked to a free end of the second limb and to a rotatable second limb string winder about which the second limb string can be wound, a rotatable second arrow string winder about which a second portion of an arrow string can be wound and a second interconnect separating the second limb string winder from the second arrow string winder and transferring a predetermined portion of a second force urging rotation of the second limb string winder to urge rotation of the second arrow string winder. The bow system is configured so that the first limb urges the first limb string winder to rotate in a manner that unwinds the first limb string from the first limb string winder and the first interconnect applies a second force urging the first arrow string winder to rotate in a manner that winds the first portion of the limb string; and wherein the bow system is configured so that the first limb urges the first limb string winder to rotate in a manner that unwinds the first limb string from the first limb string winder and the first interconnect urges the first arrow string winder to rotate in a manner that winds the first portion of the limb string. The first limb applies a force on the first limb string that urges the first limb string winder to rotate in a manner that unwinds the first limb string from the first limb string winder and the first interconnect urges the first arrow string winder to rotate in a manner that winds the first portion of the arrow string onto the first arrow string winder; and he second limb applies a force on the second limb string that urges the second limb string winder to rotate in a manner that unwinds the first limb string from the first limb string winder and the first interconnect urges the first arrow string winder to rotate in a manner that winds the first portion of the arrow string onto the first arrow string winder.

DETAILED DESCRIPTION OF THE DRAWINGS

Figure 1:
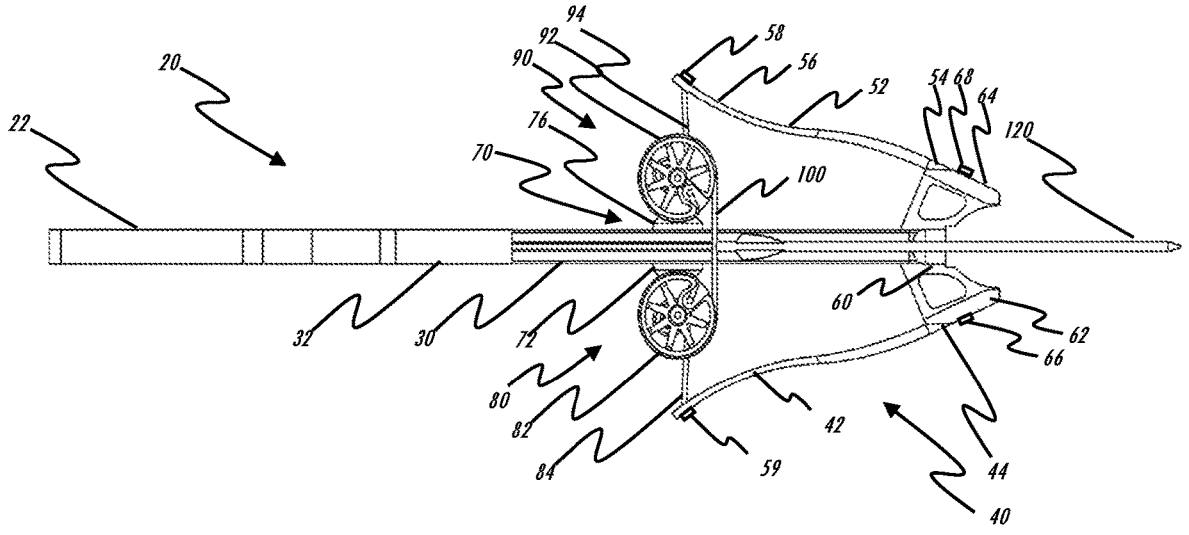
FIG. 1 is a top view of one embodiment of a crossbow in an un-drawn state.
Figure 2:
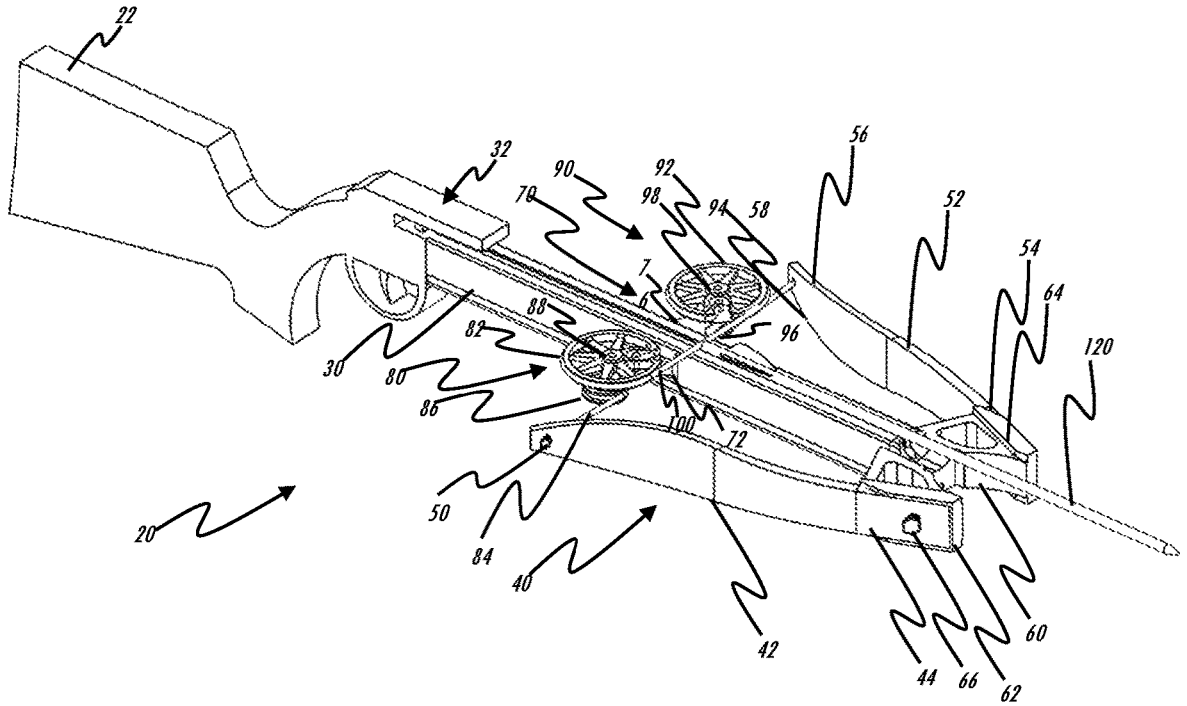
FIG. 2 is a front, top, right side perspective view of the embodiment of FIG. 1 in an un-drawn state.
Figure 3:
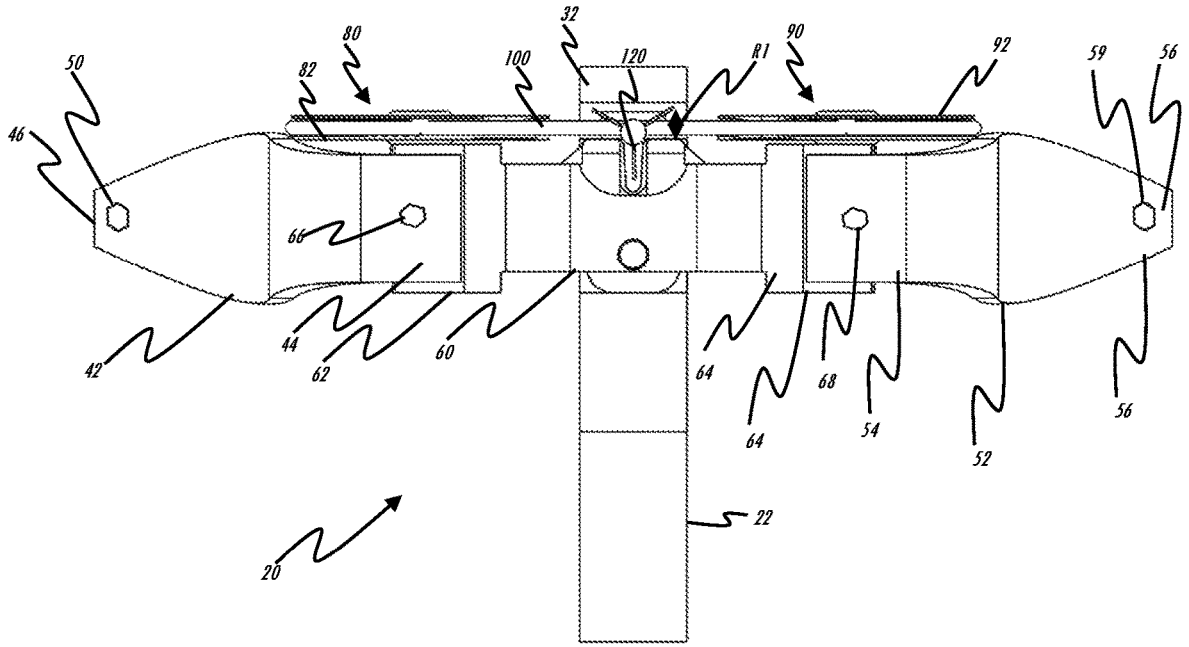
FIG. 3 is a front view of the embodiment of FIG. 1 in an un-drawn state.
Figure 4:
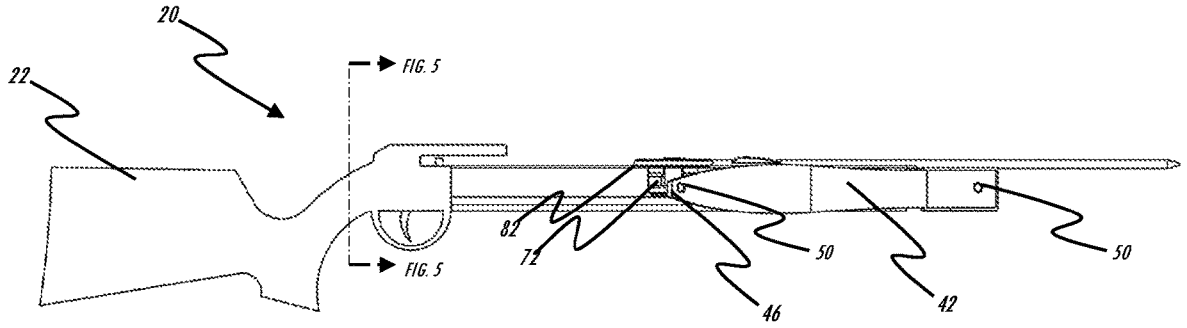
FIG. 4 shows a shows a right side view of the embodiment of FIG. 1 in an un-drawn state.
Figure 5:
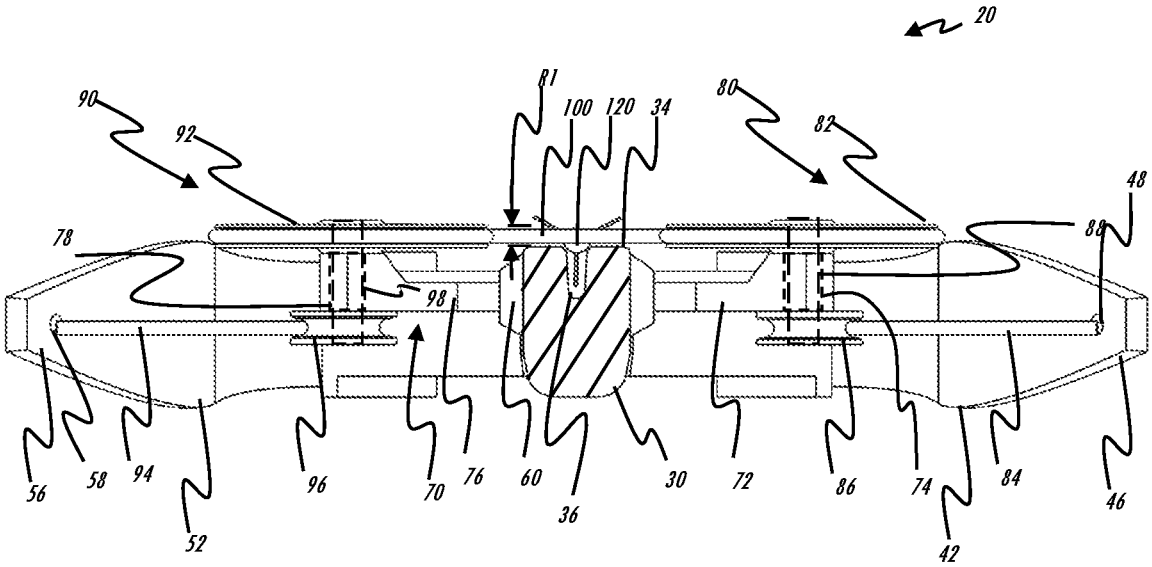
FIG. 5 shows a back cross section view of the embodiment of FIG. 1 taken as shown in FIG. 4.
Figure 6:
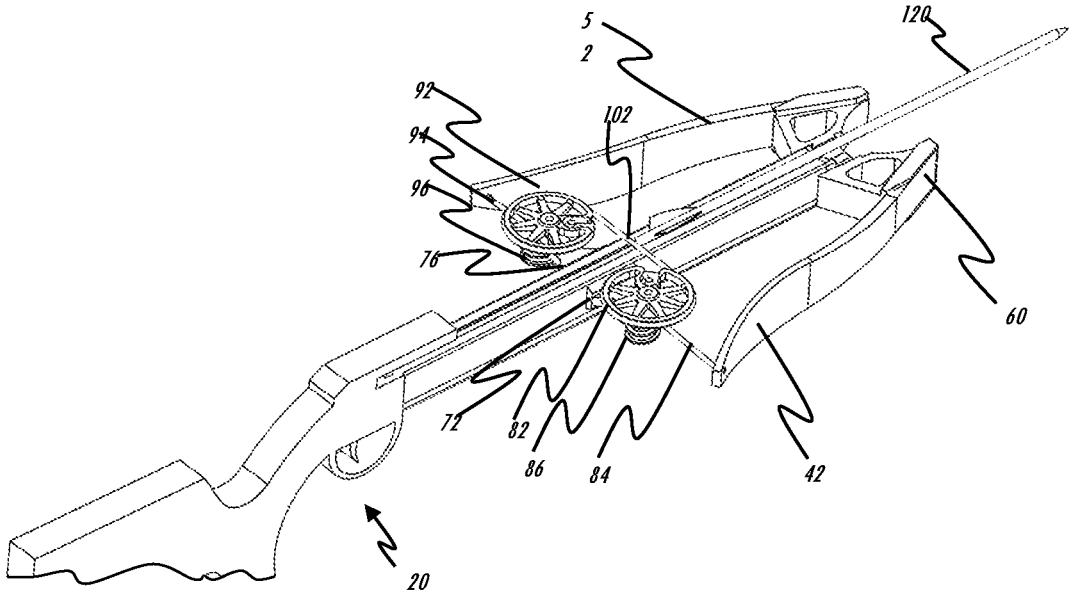
FIG. 6 shows a back, top, right side elevation view of the embodiment of FIG. 1.
Figure 7:
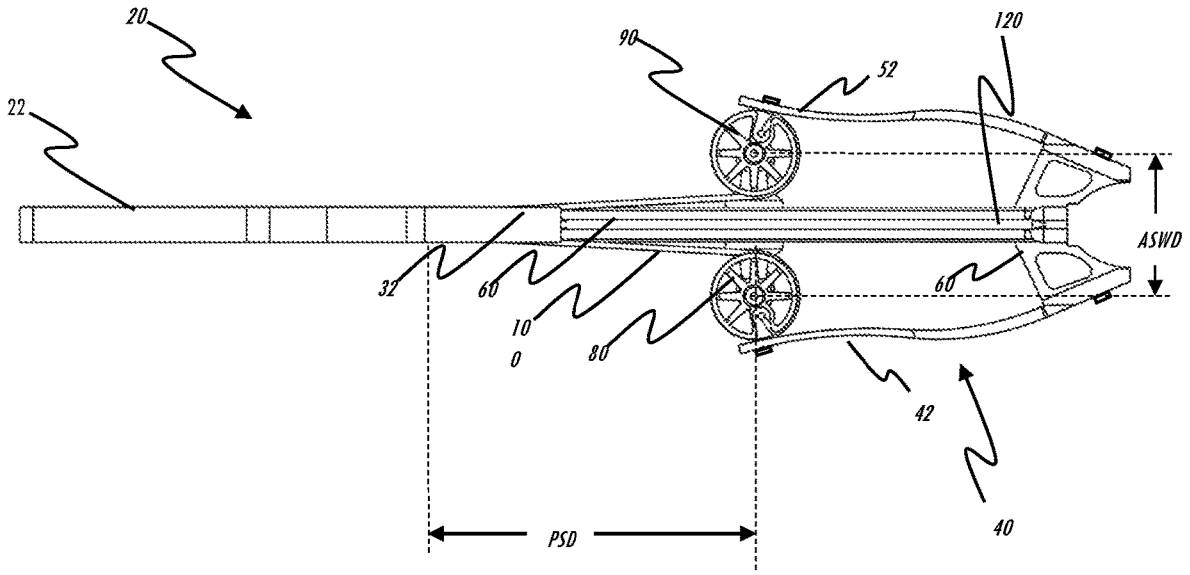
FIG. 7 shows a top view of one embodiment of a crossbow in a drawn state.
Figure 8:
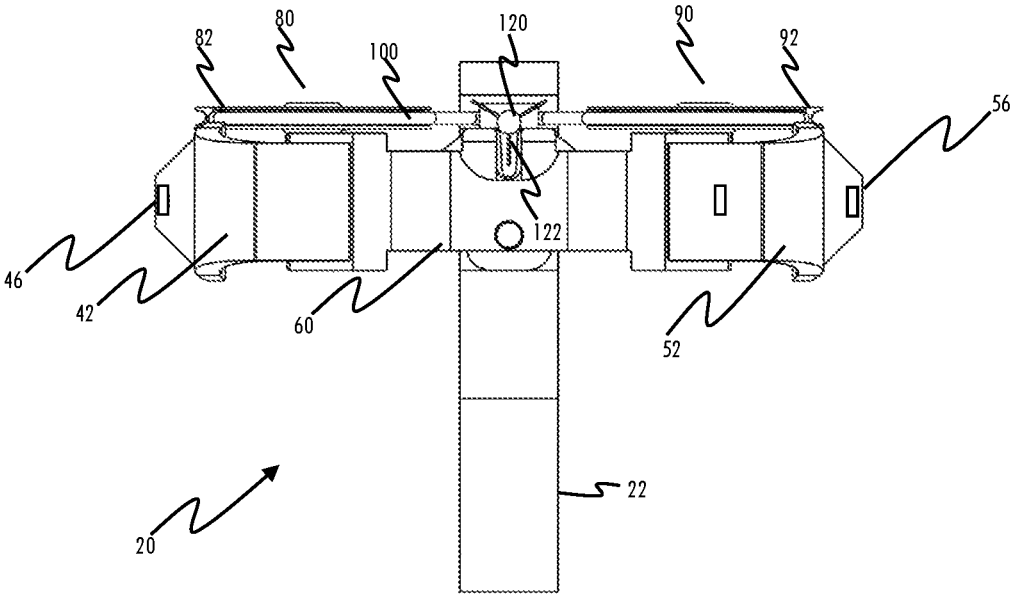
FIG. 8 is a front view of the embodiment of FIG. 1 in a drawn state.
Figure 9:
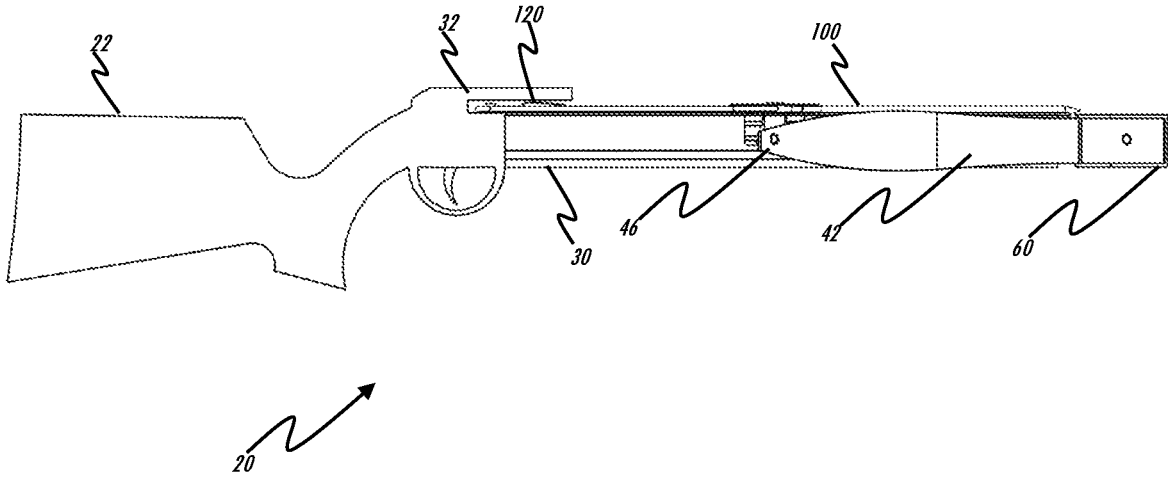
FIG. 9 is a right side view of the embodiment of FIG. 1 in a drawn state.
Figure 10:
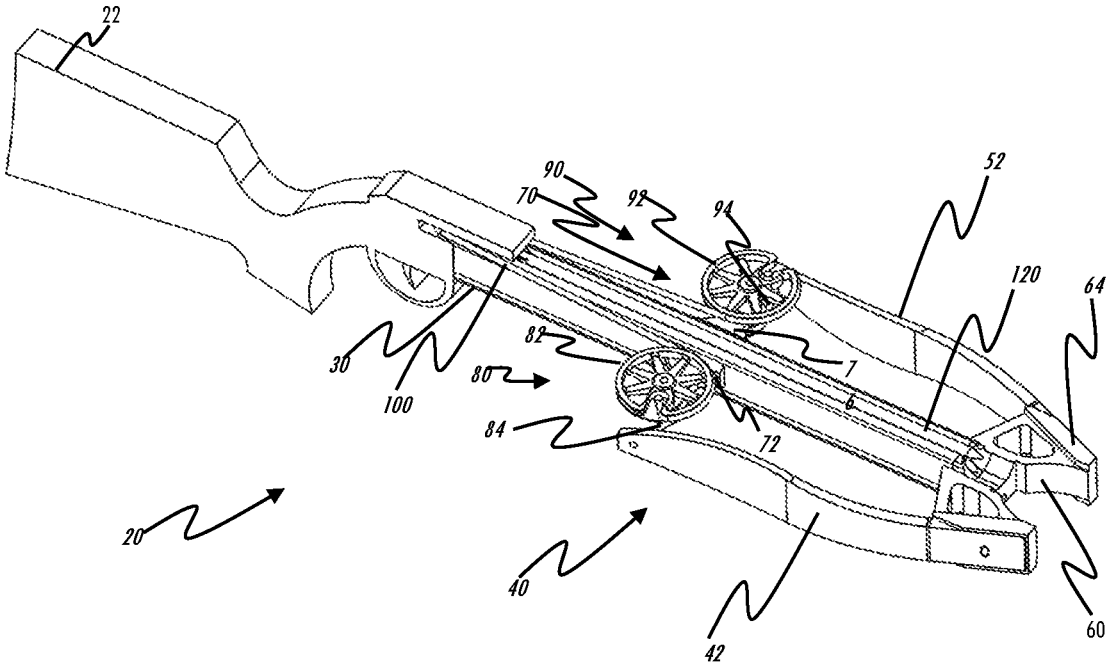
FIG. 10 is a front, top, right side isometric view of the embodiment of FIG. 1 in a drawn state.
Figure 11:
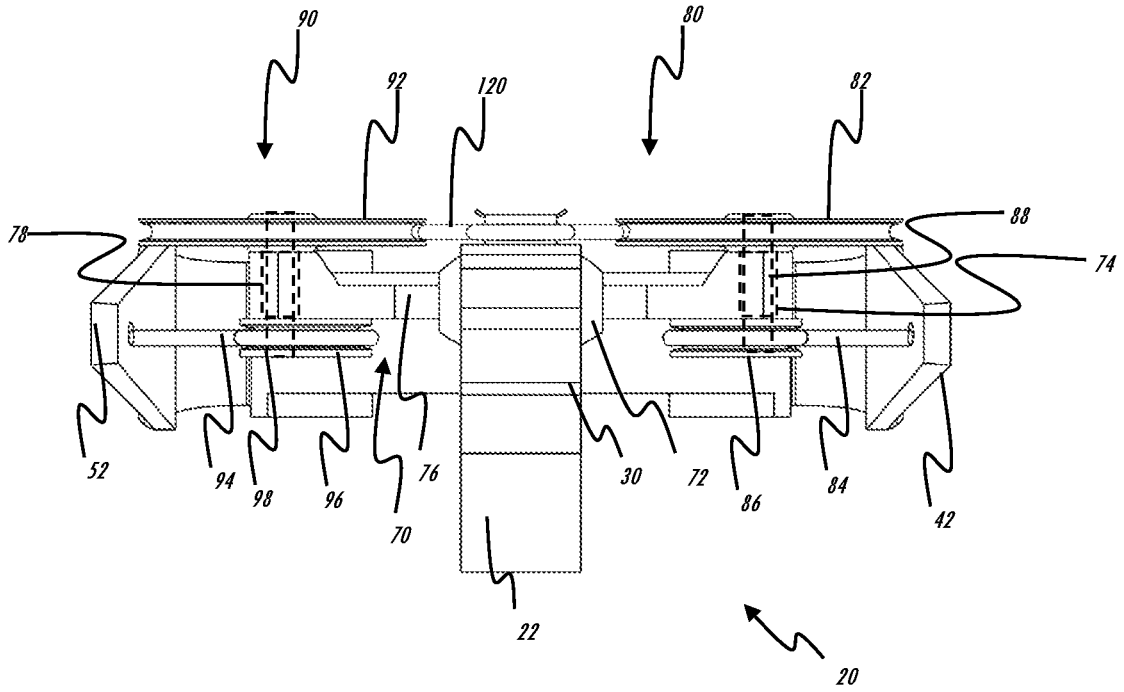
FIG. 11 is a back view of the embodiment of FIG. 1 in a drawn state.
Figure 12:
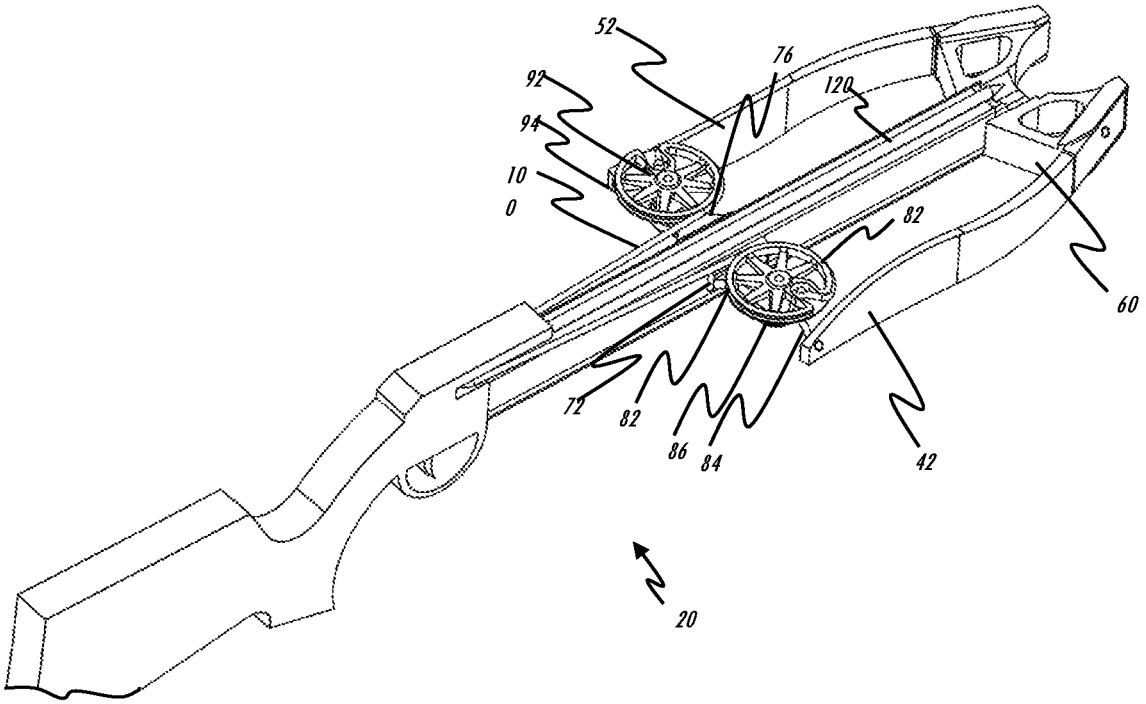
FIG. 12 shows a back, top, right side perspective view of the embodiment of FIG. 1 with a portion of a stock cut away.
Figure 13:
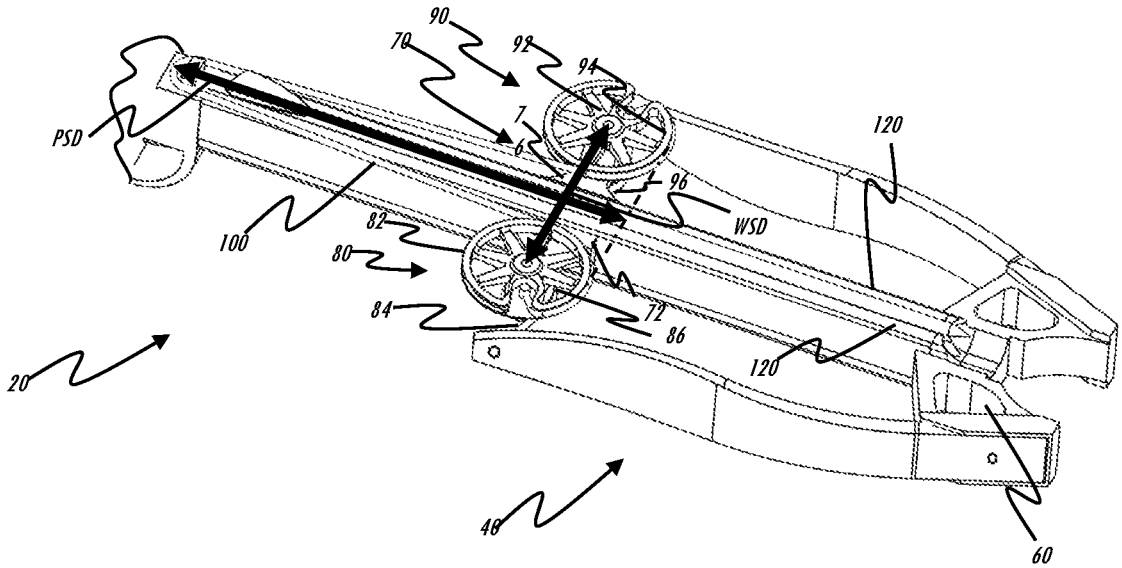
FIG. 13 is a front, top, right, perspective view of the embodiment of FIG. 1 with a stock and portions of a fire control system cut away.

FIGS. 1-13 show a first embodiment of a crossbow 20. In particular, FIG. 1 is a top view, FIG. 2 is a front, top, right side perspective view, FIG. 3 is a front view, FIG. 4 is a right side view, FIG. 5 is a back cross section view taken as shown in FIG. 4 and FIG. 6 shows a back, top, right side elevation view of the embodiment of FIG. 1 in a drawn state, while FIG. 7 is a top view of one, FIG. 8 is a front view, FIG. 9 is a right side view, FIG. 10 is a front, top, right side isometric view, FIG. 11 is a back view, FIG. 12 is a shows a back, top, right side perspective view and FIG. 13 is a front, top, right, perspective view w of the embodiment of FIG. 1 in a drawn state. FIG. 12 further shows the embodiment of FIG. 1 with a portion of a stock cut away while FIG. 13 shows the embodiment of FIG. 1 with a stock and portions of a fire control system cut away.

In this embodiment, crossbow 20 has a stock 22, a barrel 30, a fire control system 32, and a bow system 40. In this embodiment, bow system 40 has first limb 42 and second limb 52 joined to a riser 60. Here riser 60 is illustrated as being mounted to barrel 30 in other embodiments, riser 60 may be at least in part integrally formed with barrel 30 sharing for example a common substrate. Limbs 42 and 52 are held at first ends 44 and 54 respectively in a first limb mounting 62 and a second limb mounting 64 respectively. In embodiments, fasteners 66 and 68 such as bolts can be used to hold first ends 44 and 54 to first limb mounting 62 and second limb mounting 64. In this embodiment first limb mounting 62 and second limb mounting 64 are shown in the form of pocket type mountings. Other known limb mountings can be used.

Also shown in the embodiment of FIGS. 1-13 is a mounting system 70. Mounting system 70 has a first support 72 and a second support 76 that are, in this embodiment, positioned on opposing sides of barrel 30.

A first winding system 80 is mounted to first support 72 at a first winding system mount 74. First winding system 80 has a first arrow string winder 82 linked to a first limb string winder 86 by an interconnect 88. In embodiments, first arrow string winder 82 can comprise a wheel, cam, helix or other surface about which an arrow string 100 can be wound or otherwise positioned. Arrow string 100 can comprise, for example, and without limitation, a string, ribbon, wire, film, filament cable or other flexible material or combination of materials including but not limited to fibers, strands and solid materials and linked materials or structures.

In embodiments, first limb string winder 86 can comprise a wheel, cam, helix, cylinder, tube, or rod, or any surface about which a first limb string 84 can be wound or otherwise positioned. First limb string 84 can comprise, for example, and without limitation, a string, ribbon, wire, cable, film, filament or other flexible material, a combination of materials including but not limited to fibers, strands and solid materials and linked materials or structures.

First limb string 84 is joined between a free end 46 of first limb 42 and first limb string winder 86. Free end 46 and first limb string 84 are configured so that free end 46 urges or pulls first limb string 84 away from first limb string winder 86.

First limb string 84 can connect to free end 46 in a variety of different manners, in one non-limiting example shown in FIGS. 1-13, first limb 42 has a mounting feature 48 such as a hole, or surface features which can be used to facilitate mechanically associating one end of first limb string 84 with first limb 42. Optionally, an intermediary structure such as a limb string mounting 50 and can comprise for example a structure that can be joined to both first limb string 84 and limb string mounting 50 or that can comprise any other structure that can mechanically associate an end of first limb string 84 with first limb 42.

Interconnect 88 provides a structure, system or mechanism allowing energy from a force applied at one of first arrow string winder 82 and first limb string winder 86 to be applied at least in part against the other of first arrow string winder 82 and first limb string winder 86. In embodiments, interconnect 88 can respond to changes in an extent of rotation of first limb string winder 86 by causing extent of rotation of first arrow string winder 82 to change. Similarly, in embodiments, interconnect 88 can respond to a change in an extent of rotation of first arrow string winder 82 by causing an extent of rotation of first limb string winder 86 to change.

Interconnect 88 can provide a direct or indirect linkage between first arrow string winder 82 and first limb string winder 86. Additionally, there can be a singular linkage or a plurality of linkages. In embodiments, interconnect 88 can take the form of a mechanical connection between first arrow string winder 82 and first limb string winder 86 such as a rod, gear train, transmission, or other form of linkage. Such a linkage can be direct or indirect. Additionally, in embodiments, interconnect 88 can comprise a singular linkage or a plurality of linkages.

In embodiments, interconnect 88 can include an energy storage and release system including for example and without limitation, resilient members including but not limited to springs, torsion bars, inertial energy storage devices such as flywheels and other structures or systems that are capable of storing a portion the energy from a force applied at one of first arrow string winder 82 and first limb string winder 86 as potential energy that may be released to drive motion of the other of first arrow string winder 82 and first limb string winder 86. This may be done, for example, to store energy in interconnect 88 during drawing that interconnect 88 may release during firing. The release of this stored energy can be used for purposes such as causing arrow string 100 to apply force to arrow 120 according to a predetermined pattern. Such a predetermined pattern may deliver controlled ranges of energy to arrow 120 when arrow 120 is at different positions along a length of barrel 30 during firing or during different portions of the time at which arrow 120 is receiving energy from arrow string 100. The predetermined pattern can be defined for example and without limitation for purposes such as helping to achieve desired acceleration and velocity curves for arrow 120.

In embodiments, interconnect 88 can also include an energy storage and release system that can store and release potential energy in a manner that helps to improve the consistency with which arrow string 100 provides a pattern of force to arrow 120 during firing. Such consistency can help to achieve consistent acceleration and velocity curves for arrow 120. In some embodiments of this type, this objective can be accomplished by using the released energy to compensate for fabrication, manufacturing or material variations.

In embodiments, interconnect 88 can store and release potential energy to help ensure rotational alignment of first arrow string winder 82 with that of a second arrow string winder 92. Ensuring rotational alignment in this manner can help to improve accuracy of a flight path of an arrow 120.

In embodiments, interconnect 88 can store and release potential energy to manage noise and vibration created by crossbow 20 during use.

In embodiments, interconnect 88 may also include a rate limiter or rate balancing system for similar purposes.

As is illustrated in FIG. 5, first winding system mount 74 positions first winding system 80 so that first arrow string winder 82 engages arrow string 100 within a first predetermined range of positions R1 relative to barrel surface 34.

In FIGS. 1-13, an embodiment of interconnect 88 is shown in the form of a rod that connects first arrow string winder 82 to first limb string winder 86. Here, interconnect extends through a first winding system mount 74, shown in the form of a passageway, through which this rod type embodiment of interconnect 88 passes and is supported. In this embodiment first winding system mount 74 optionally may act as a bearing surface and may be prepared through surface finishing or post-processing techniques to perform this function. In embodiments, first winding system mount 74 may incorporate bearing components or assemblies (not shown) to provide friction reducing structures such as ball bearings, roller bearings, fluid bearings, magnetic bearings or other known types of bearing.

A second winding system 90 is mounted to second support 76 at a second winding system mount 78. Second winding system 90 has a second arrow string winder 92 linked to a second limb string winder 96 by a second interconnect 98. In embodiments, second arrow string winder 92 can comprise a wheel, cam, helix or other surface about which an arrow string 100 can be wound or otherwise positioned. Arrow string 100 can comprise, for example, and without limitations a string, ribbon, wire, cable or other flexible material or combination of materials including but not limited to fibers, strands, solid materials and linked materials or structures.

In embodiments, second limb string winder 96 can comprise a wheel, cam, helix, cylinder, tube, or rod, or any surface about which a second limb string 94 can be wound or otherwise positioned. Second limb string 94 can comprise, for example, and without limitation, a string, ribbon, wire, cable, film, filament or other flexible material, a combination of materials including but not limited to fibers, strands, solid materials and linked materials or structures.

Second limb string 94 is joined between a free end 56 of second limb 52 and second limb string winder 96. Free end 56 and second limb string 94 are configured so that free end 56 urges or pulls second limb string 94 away from second limb string winder 96.

Second limb string 94 can connect to free end 56 in a variety of different manners, in one non-limiting example shown in FIGS. 1-6, second limb 52 has a mounting feature 58 such a hole or surface features that can be used to mechanically associate second limb string 94 to second limb 52. Optionally, an intermediary structure such as a limb string mounting 59 can be used to mechanically associate an end of second limb string 94 with second limb 52.

Second interconnect 98 provides a structure, system or mechanism allowing energy from a force applied at one of second arrow string winder 92 and second limb string winder 96 to drive rotation of the other of second arrow string winder 92 and second limb string winder 96. In one embodiment, second interconnect 98 can respond to changes in an extent of rotation of limb string winder 96 by causing an extent of rotation of second arrow string winder 92 to change. Similarly, in embodiments, second interconnect 98 can respond to a change in an extent of rotation of second arrow string winder 92 by causing an extent of rotation of second limb string winder 96 to change.

In embodiments, second interconnect 98 can take the form of a mechanical connection between second arrow string winder 92 and second limb string winder 96 such as a rod, gear train, transmission, or other form of linkage. Such a linkage can be direct or indirect. Additionally, in embodiments, second interconnect 98 can comprise a singular linkage or a plurality of linkages.

In embodiments, second interconnect 98 can include an energy storage and release system including, for example and without limitation, resilient members including but not limited to springs, torsion bars and other structures capable of storing a portion of the energy from a force applied at one of second arrow string winder 92 and second limb string winder 96 as potential energy that may be released to drive motion of the other of second arrow string winder 92 and second limb string winder 96. This may be done, for example, to store energy in second interconnect 98 during drawing that second interconnect 98 may release during firing. The release of this stored energy can be used for purposes such as causing arrow string 100 to apply force to arrow 120 according to a predetermined pattern. Such a predetermined pattern may deliver controlled ranges of energy to arrow 120 when arrow 120 is at different positions along a length of barrel 30 during firing or during different portions of the time at which arrow 120 is receiving energy from arrow string 100. The predetermined pattern can be defined for example and without limitation for purposes such as helping to achieve desired acceleration and velocity curves for arrow 120.

In embodiments, second interconnect 98 can also include an energy storage and release system that can store and release potential energy in a manner that helps to improve the consistency with which arrow string 100 provides a pattern of force to arrow 120 during firing. Such consistency can help to achieve consistent acceleration and velocity curves for arrow 120. In some embodiments of this type this objective can be accomplished by using the released energy to compensate for fabrication, manufacturing or material variations.

In embodiments, second interconnect 98 can store and release potential energy to help ensure rotational alignment of first arrow string winder 82 with that of second arrow string winder 92. Ensuring rotational alignment in this manner can help to improve accuracy of a flight path of arrow 120.

In embodiments, second interconnect 98 can store and release potential energy in ways that help to manage noise and vibration created by crossbow 20 during use.

In embodiments second interconnect 98 may also include a rate limiter, clutch or rate balancing systems for similar purposes.

As is shown in FIG. 5, in this embodiment, second side mounting 78 positions second winding system 90 so that second arrow string winder 92 can engage arrow string 100 within the first predetermined range of positions R1 relative to barrel surface 34.

In the embodiment of FIGS. 1-13, a second interconnect 98 is shown in the form of a rod that connects second arrow string winder 92 and second limb string winder 96. Here, second interconnect 98 extends through a second winding system mount 78, shown in the form of a passageway, through which this rod type embodiment of second interconnect 98 passes and is supported. In this embodiment, second winding system mount 78 optionally may act as a bearing surface and may be prepared through surface finishing or post-processing techniques to perform in this role. In embodiments, second winding system mount 78 may incorporate bearing components or assemblies (not shown) to provide friction reducing structures such as ball bearings, roller bearings, fluid bearings, magnetic bearings or other known types of bearings.

In other embodiments, interconnect 88 can incorporate or comprise a transmission, gear system, pulley systems or other mechanical structures providing a mechanical advantage between an output at arrow string winder 82 and an input at first limb string winder 86 and vice versa. Similarly, second interconnect 98 can incorporate or comprise a transmission, gear system, pulley systems or other mechanical structures providing a mechanical advantage between an output at second arrow string winder 92 and an input at limb string winder 96 and vice versa.

In embodiments, arrow string winders 82 and 92 are adapted to receive wound portions of arrow string 100 such that the respective positions of arrow string winders determine the position of arrow string 100. In the embodiment illustrated, arrow string winders 82 and 92 are generally illustrated as being circular and each arrow string winder winds arrow string 100 along a generally circular path with a center axis of rotation that is generally aligned with an axis of rotation of the arrow string winder. In embodiments, the axis of the circular path and the axis of rotation may be substantially coincident such that the axis of the circular path is concentric about the axis of rotation.

In embodiments, arrow string winders 82 and 92 can take up a length of arrow string that is generally consistent per unit of rotation during the firing cycle. Similarly, in such embodiments arrow string winders 82 and 92 can pay out a length of arrow string 100 that is generally consistent per unit of rotation during the drawing cycle.

In other embodiments, at least one of arrow string winders 82 and 92 are adapted to wind portions of arrow string 100 in a way that is not concentric with an axis of rotation of arrow string winders 82 and 92. Such an eccentric winding path, for example, can be used to control the string payout per unit of rotation by moving respective portions of arrow string 100 closer to or further from each arrow string winder's axis of rotation.

Arrow string winding paths may be generally elliptical, circular or may be asymmetrical in nature. Examples of such asymmetrical paths include but are not limited to arcurate, discontinuous, fractal, spline based or other shapes and formations and combinations thereof configured to provide distinct effects on arrow string 100 as arrow string winders 82 and 92 are rotated during drawing and firing cycles. For example and without limitation, arrow string winding paths may be defined to draw different lengths of arrow string 100 per unit of rotation of arrow string winders 82 and 92. This can be done for example and without limitation to provide an extent of "let off" or modulated drawing force during certain portions of drawing of arrow string 100, to ensure that arrow string 100 maintains contact with and drives arrow 120 during firing, and for other purposes.

In the embodiment shown, arrow string winders 82 and 92 are shown as being inversely rotated and wind arrow string 100 along arrow string paths that are generally mirrored about the central plane of the barrel 30. In the embodiment shown, arrow string winders 82 and 92 are configured to provide arrow string paths that pay out or wind generally equal amounts of a length of arrow string 100 during firing and drawing respectively. This can be done for example so that there is a generally equivalent extent of lateral pull on a center point or other nock engagement point 102 of arrow string 100 that is used to apply force to arrow 120 which can be mirrored about a central plane of barrel 30 or other axis along which barrel 30 advances arrow 120. This reduces or eliminates an extent of any lateral nock travel in a direction perpendicular to the direction of barrel 30 during firing. This limits lateral inaccuracies of a trajectory of arrow 120 potentially caused by such lateral nock travel.

In embodiments illustrated herein arrow string winders 82 and 92 have been arranged so that when arrow string 100 comes to rest in the undrawn state, arrow string 100 extends across barrel 30 at a point that is further from fire control system 32 than the axes of rotation of arrow string winders 82 and 92. Such a configuration offers the advantage of greater power stroke distance. This is not limiting, however, and in embodiments arrow string winders 82 and 92 can be arranged so that when arrow string 100 comes to rest in the undrawn state, arrow string 100 extends across barrel 30 at a point that is between fire control system 32 and the axes of rotation of arrow string winders 82 and 92.

To draw crossbow 20, external energy is supplied move arrow string 100 so that crossbow 20 transitions from an initial state shown in FIGS. 1-6 to a drawn state shown in FIGS. 7-12. As arrow string 100 is moved, arrow string winders 82 and 92 rotate. Rotation of arrow string winders 82 and 92 cause movement of interconnects 88 and 98. Rotation of interconnects 88 and 98 in turn cause limb string winders 86 and 96 to rotate. Rotation of limb string winders 86 and 96 winds limb strings 84 and 94 onto limb string winders 86 and 96 and elastically deflect free ends 46 and 56 of limbs 42 and 52 toward limb string winders 86 and 96. Limbs 42 and 52 resist deflection from their static position. This resistance generates forces that are transmitted through limb strings 84 and 94 urging limb string winders 86 and 96 to rotate in a direction that would unwind limb strings 84 and 94 from limb string winders 86 and 96. Accordingly, during drawing, forces must be applied to move arrow string 100 along barrel 30 that overcome the forces created by limbs 42 and 52 as transmitted through winding systems 80 and 90. Once in the drawn position, fire control system 32 captures arrow string 100 to hold arrow string 100 in a fixed position for loading arrow 120 and aiming prior to firing.

Crossbow 20 is defined so that first limb 42, first winding system 80, second limb 52, and second winding system 90 generally apply equal but oppositely directed force on arrow string 100 about a center point or other nock engagement point 102. Crossbow 20 is also defined so that a predetermined amount of arrow string 100 remains wound on both first arrow string winder 82 and second arrow string winder 92 when in the un-drawn state. As is shown in FIGS. 7-12, the drawing of arrow string 100 from the un-drawn position to the drawn position causes rotation of winding systems 80 and 90 which causes further elastic deformation and bending of limbs 42 and 52 to store potential energy therein.

As is shown in FIGS. 7-13, in the drawn state, arrow string 100 is pulled back to fire control system 32. Fire control system 32 grips arrow string 100 and holds arrow string 100 against the bias, pull or urging, supplied by elastically deformed limbs 42 and 52 through winding systems 80 and 90 and holds winding systems 80 and 90 and limbs 42 and 52 in the drawn state. While in the drawn state a user can then load arrow 120 onto barrel 30 and aim crossbow 20 without actively working to resist the forces by limbs 42 and 52.

When fire control system 32 is activated, fire control system 32 releases arrow string 100 allowing free movement winding systems 80 and 90 and arrow string 100 in response to the urging of limbs 42 and 52. This has the effect of rapidly winding arrow string 100 onto first arrow string winder 82 and second arrow string winder 92. As this winding occurs, arrow string 100 is rapidly drawn along a length of barrel 30 to thrust arrow 120 along barrel 30 toward a target.

It will be appreciated that in the embodiment of FIGS. 1-13, limb string winders 86 and 96 are illustrated as being eccentrically mounted to interconnects 88 and 98. This causes limb strings 84 and 94 to wind along eccentric winding paths about an axis of rotation of limb string winders 86 and 96 which provides a predetermined mechanical advantage useful in achieving a desired input and output profile curve. For example one possible input/output profile curve could be parabolic in nature so that an amount of force required to pull arrow string 100 is not proportional throughout the draw cycle. This can be used for example and without limitation to allow a user to draw arrow string 100 a particular distance away from the undrawn position while experiencing a generally predetermined pattern of loading during the drawing process.

It will be observed from FIGS. 7-12, that in this embodiment, crossbow 20 exhibits the optional feature of having at least a portion of limbs 42 and 52 that can be drawn within the lateral extent of first arrow string winder 82 and second arrow string winder 92 when in the drawn state. This allows limbs 42 and 52 to have additional travel between the un-drawn configuration and the drawn configuration, which in turn allows greater storage of energy in limbs 42 and 52 while maintaining a narrow profile in the initial configuration.

The embodiments of FIGS. 1-13 provide a crossbow that is not challenged by one or more of the many problems confronting the designer of crossbow of conventional design. For example, in a conventional design wheels or cams are mounted to free ends of opposing crossbow limbs. Mounting such wheels and cams to limbs that will flex during use inherently limits the positional accuracy with which the cams or wheels of a conventional bow can maintained relative to other components of such crossbows during drawing and firing. Additionally, this approach adds un-sprung mass to the limbs which adds inertial resistance or drag to free ends of the limbs. Furthermore, in a conventional design, such wheels and cams must be mounted to the free ends of the limbs and therefore must be designed to withstand the shock and vibration arising at the free ends.

In embodiments of crossbow 20 however, comparatively little mass is added to the free ends 46 and 56 of limbs 42 and 52, thus crossbow 20 has a substantially lower amount of un-sprung mass at free ends 46 and 56 of limbs 42 and 52 than can be provided using a conventional crossbow arrangement.

Additionally, it will be noted that wheels or cams of conventional crossbows are mounted to conventional limbs that, in turn, are designed to act as springs and therefore prone to flex undesirably when exposed to torsional forces. This can allow torsional flexing of the limbs and can cause the cams to lean, which can have the effect of mis-positioning the bowstring. In such conventional crossbows, this effect is mitigated by configuring the bow so that the bowstring of such a bow presses against a barrel surface of a barrel such that a string of such a crossbow drags along the surface of a barrel during firing. This in turn creates friction during firing which reduces the amount of energy available for transfer to the arrow and reduces string speed driving the arrow. Ultimately, this friction can wear and prematurely degrade the bowstring components.

Further, it will be noted that the need to mount wheels or cams to conventional crossbow limbs also imposes constraints on the design of such crossbow limbs, impacting a wide variety of characteristics of such limbs including but not limited to material choices, limb lengths and limb shapes. As a result, the crossbow limb design and manufacture is made unnecessarily complex and expensive by the practice of using limbs having wheels or cams mounted thereto.

In contrast, in crossbow 20 winding systems 80 and 90 are mounted by way of a mounting system 70 which is not mounted to limbs 42 and 52. Instead, mounting system 70 can be joined, directly or indirectly to structures such as stock 22, barrel 30 or riser 60. This ensures that the position of arrow string winders 82 and 92 relative to barrel 30, barrel surface 34 and fire control system 32 can be maintained with greater accuracy. Additionally, as the design mounting system 70 is not constrained by un-sprung mass considerations, mounting systems 70 can provide a stronger or more robust supports 72 and 76 which can help to ensure that desired positional relationships are maintained and can also provide a base of support that can better resist the forces involved in crossbow drawing and firing than can conventional limb based mountings. A further advantage is that winding systems 80 and 90 can be made more robust and stronger to better resist torsional forces during drawing and firing than can conventional string management systems having cams or wheels that are designed to be mounted to the free ends of limbs in a conventional crossbow. This allows for precise placement first arrow string winder 82 and second arrow string winder 92 so that there is no need to apply a level of downforce of arrow string 100 against barrel surface 34 as is done in conventional arrangements to manage torsion problems. In embodiments, this may increase the amount of energy that a crossbow 20 can transfer to arrow 120 and may increase the speed at which arrow string 100 can drive arrow 120 along barrel surface 34 as compared to conventional arrangements. Additionally, wear caused by friction between barrel surface 34 and arrow string 100 can be reduced or eliminated.

Figure 14:
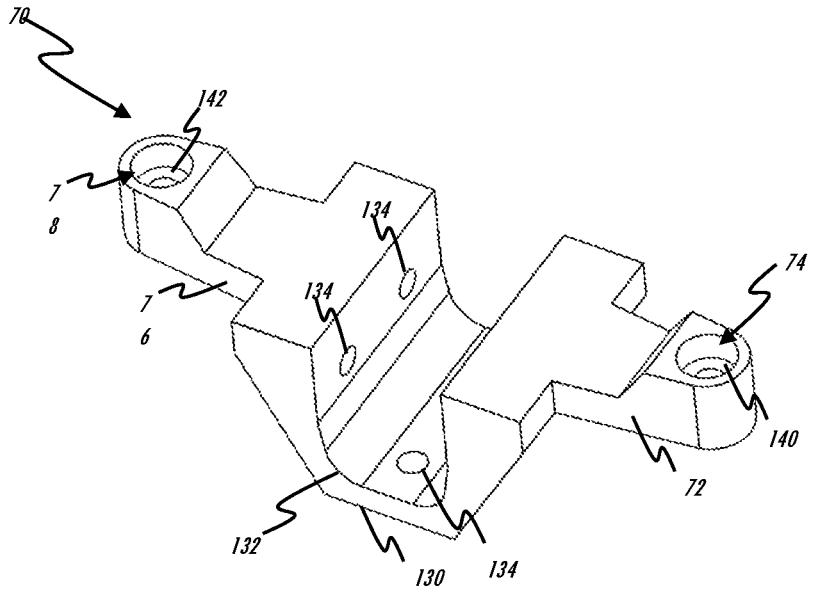
FIG. 14 is a top, rear and right side perspective view of a mounting system.
Figure 15:
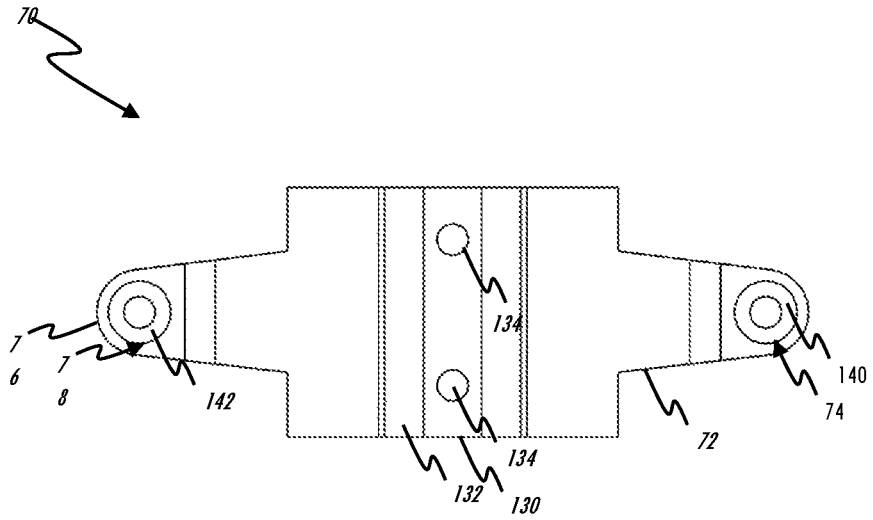
FIG. 15 is a top view of the mounting system of FIG. 14.
Figure 16:
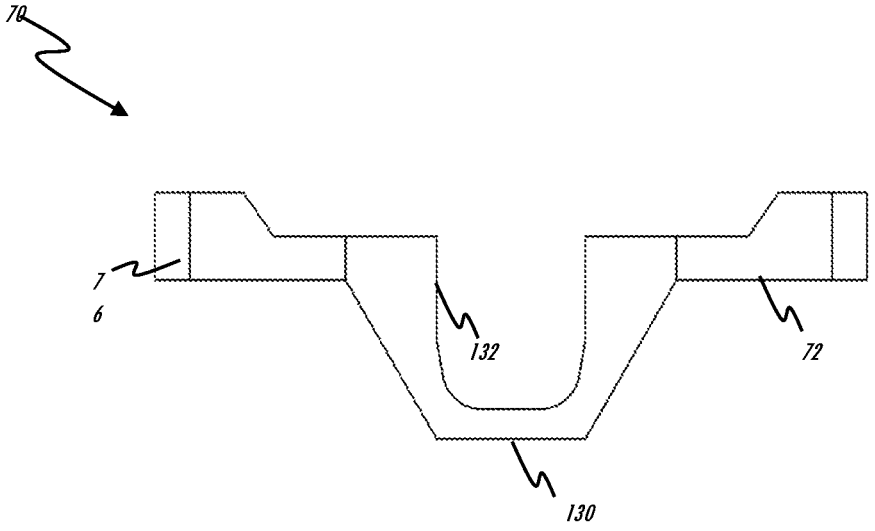
FIG. 16 is a rear view of the mounting system of FIG. 14.

One example of a mounting system 70 is illustrated in FIGS. 14-16 which show, respectively a top, rear and right side perspective view, a top view and a rear view of mounting system 70. As is shown in FIGS. 14-16 mounting system 70 is provided having a first support 72 and a second support 76 that are mechanically linked by a unimount 130. In this embodiment, unimount 130 has at least one surface engagement surface 132 shaped and sized so unimount 130 can be fixedly joined to barrel 30 or with a stock 22 or other structure that is positioned in a generally fixed relation to barrel 30. Additionally, in this embodiment, one or more engagement features 134 can be provided to enable mechanical location of barrel 30 relative to mounting system 70 with mounting system 70 with a predetermined range of rigidity. Here engagement features 134 are illustrated as comprising holes however other mounting surfaces such as projections or cavities in unimount 130 may be used to engage co-designed mounting features on barrel 30 or some other structure between barrel 30 and unimount 130. Further, fasteners or other mountings may interact with engagement surfaces 132 and barrel 30 or with a stock 22 or other structure through which a generally fixed relation to barrel 30 can be established.

In embodiments, unimount 130 may be integrally formed with barrel 30 such as by sharing a common substrate or being formed in a common operation. In other embodiments, unimount 130 may be defined to join to or to be integrally formed with a stock 22 or other structure that is positioned in a generally fixed relation to barrel 30 such as riser 60.

In this example, first support 72 provides a first winding system mount 74 that extends from a top to a bottom of first support 72 while second support 76 provides a second winding system mount 78 that extends from a top to a bottom of second support 76. As is shown in FIGS. 14 and 15, first winding system mounting 74 has an optional first inset surface 136 and second winding system mount has a second inset surface 138. First inset surface 136 and second inset surface 138 can provide areas within which a bearing, journal or other surface or assembly can be positioned. Inset surfaces 136 and 138 can be milled, forged, or cast, drilled, bored, or formed using any other know method for forming features of like kind.

In embodiments, first support 72, second support 76 and unimount 130 can be formed or assembled before first winding system mount 74 and second winding system mount 78 are provided. In one non-limiting example, unimount 130 can be extruded having features such as, for example, first support 72 and second support 76 and cut to a preferred length. After such cutting a milling or drilling operation can be applied that bores or otherwise forms first winding system mount 74 and second winding system mount 78 in the previously formed first support 72, second support 76 of unimount 130. In this embodiment, first winding system mount 74 and second winding system mount 78 can be formed in the same operation so that refixturing the work piece is not necessary. This approach can help to ensure that geometric relationships between first winding system mount 74 and second winding system mount 78 are maintained within a predetermined and limited range of variability relative to each other irrespective of any geometric variabilities in the first support 72, second support 76 and unimount 130. Optionally, other processes such as the formation of engagement surfaces 132 can be performed in the same operation. Without limitation, any features of mounting system 70 could be milled, forged, or cast, drilled, bored, or formed using any other know method for forming features of like kind.

In embodiments, first winding system 80 and second winding system 90 may operate in a substantially similar manner while providing opportunities for independent adjustment. For example, and without limitation, adjustment of a length of one or both of limb strings 84 and 94 can be used to offset the effects that potential differences in a spring constant between first limb 42 and second limb 52 when arrow string 100 is in the drawn position. This can be done for example by providing a user adjustable mechanism that allows adjustment of the relative position at which first limb string 84 is mounted to free end 46 of first limb 42 within a range of positions thereby impacting the overall length of first limb string 84 between first limb 42 and first limb string winder 86. One non-limiting example of such a mechanism is a set screw that is positioned either at first limb 42 or first limb string winder 86 that can be turned in one direction to increase a length of first limb string 84 and in another direction to decrease a length of first limb string 84. Other known structures can be used in this regard.

It will also be appreciated that the present embodiment allows an arrow string winder such as first arrow string winder 82 to rotate along a plane that is vertically separated from a plane of rotation of first limb string winder 86. This offers increased flexibility in the design of crossbow 20. As is shown in FIG. 11, such flexibility can optionally be used to enable, for example, crossbow 20 to be configured so that first arrow string winder 82 and second arrow string winder 92 can be positioned generally within the protective lateral area between first limb 42 and second limb 52 when in the un-drawn state, while also allowing first limb 42 and second limb 52 to closely approach or, in embodiments, to move within the lateral space also occupied vertically by first arrow string winder 82 and second arrow string winder 92 during drawing and firing.

In embodiments, this capability can be used to allow both a significant extent of limb deflection between a drawn state and an undrawn state while still enabling both first arrow string winder 82 and second arrow string winder 92 to receive and pay out a predetermined length of arrow string 100 that is sufficient to enable drawing and firing of crossbow 20. For example, and without limitation, in this embodiment first arrow string winder 82 and second arrow string winder 92 can have a diameter or other large axis defining a surface or plurality of surfaces against which a significant length of arrow string 100 can be stored. It will be appreciated that such a large diameter axis of rotation may increase the forces experienced by first winding system mount 74 and second winding system mount 78 to levels that would be impractical, complex or expensive for a conventional limb mounted wheel or cam. However, first winding system mount 74 and second winding system mount 78 can be made significantly more robust than limb based mountings as they do not create the unsprung mass problems of the prior art.

In embodiments, a power stroke distance PSD between a position where arrow string 100 passes a mid-line of barrel 30 when positioned in the undrawn state and a position where arrow string 100 passes a mid-line of barrel 30 when positioned in the drawn state can be at least about three times longer than an arrow string winder separation distance WSD between an axis of rotation of first arrow string winder 82 and an axis of rotation of second arrow string winder 92. Further, it will be noted that in embodiments, even greater ratios of power stroke distance PSD to arrow string winder separation distances WSD can be achieved for example by providing a greater length of barrel 30 between fire control system 32 and the point at which arrow string 100 crosses over barrel 30 in the undrawn state and by increasing the length of arrow string 100 that can be wound onto first arrow string winder 82 and second arrow string winder 92.

Figure 17:
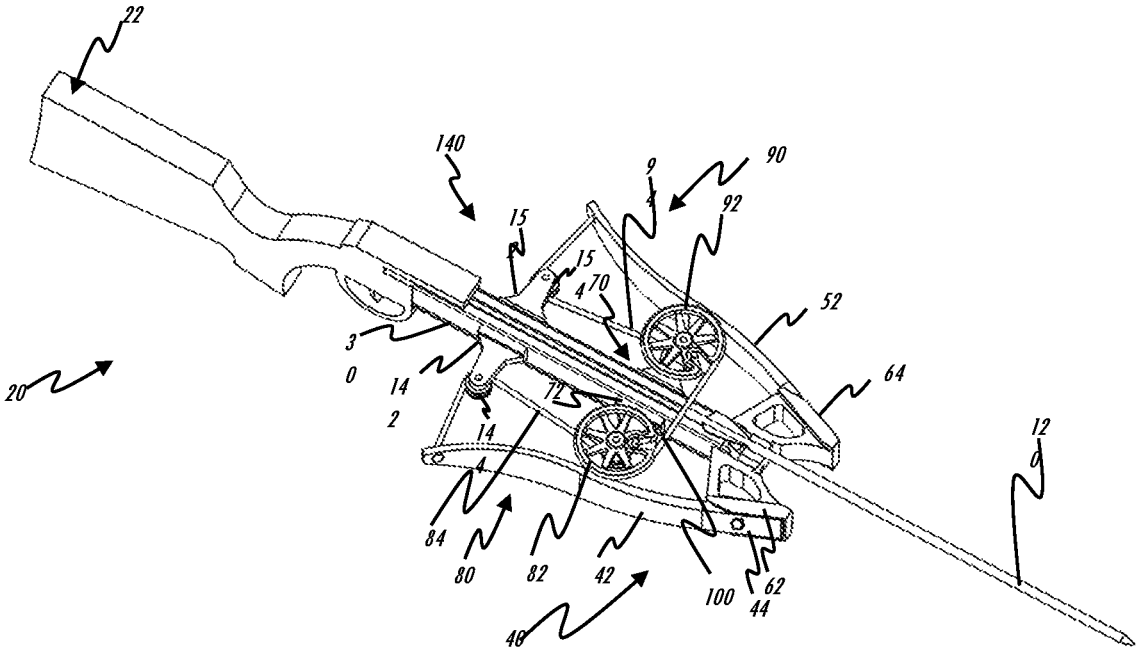
FIG. 17 is a right, top, front perspective view of another embodiment of a crossbow in an undrawn state.
Figure 18:
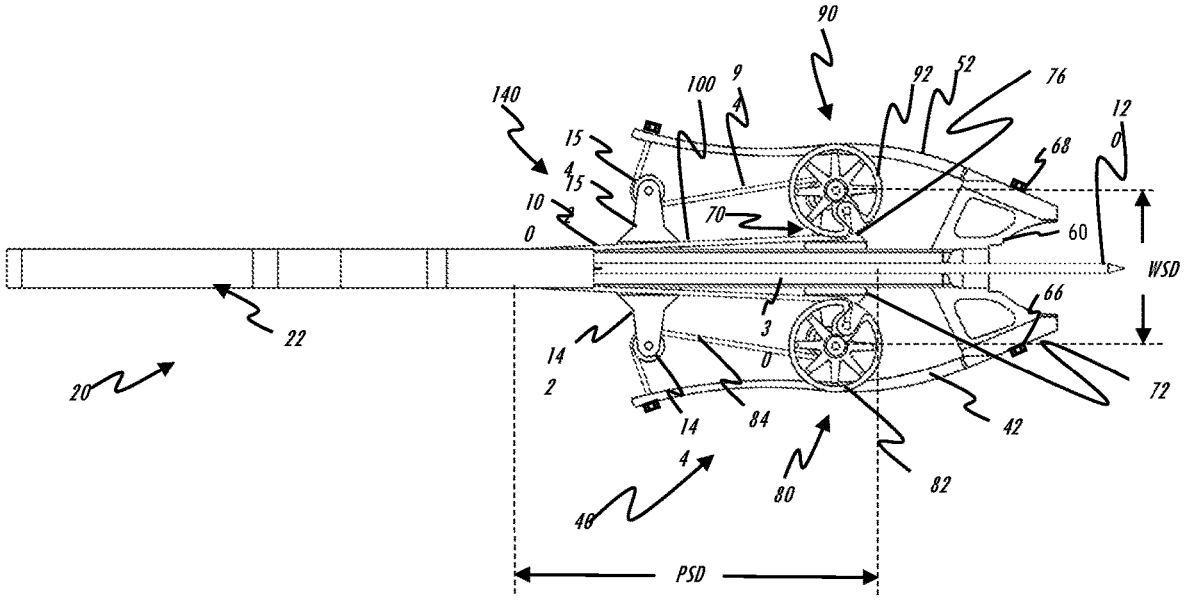
FIG. 18 is a top view of the embodiment of FIG. 17 in a drawn state.
Figure 19:
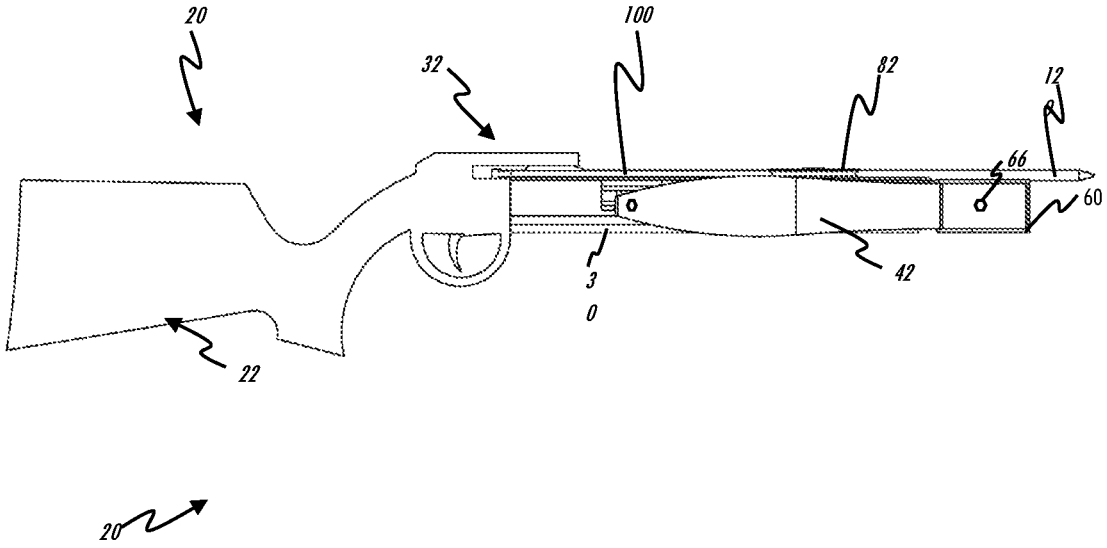
FIG. 19 is a right side elevation view of the embodiment of FIG. 17 in a drawn state.
Figure 20:
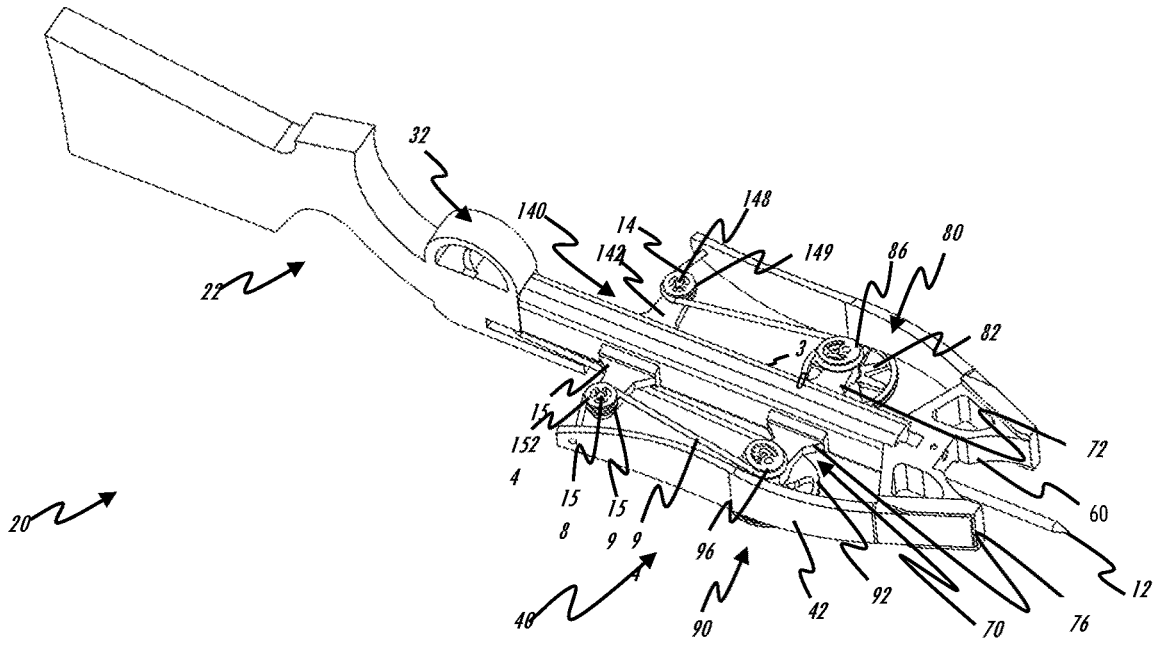
FIG. 20 is a left, bottom, front perspective view of the embodiment of FIG. 17 in a drawn state.
Figure 21:
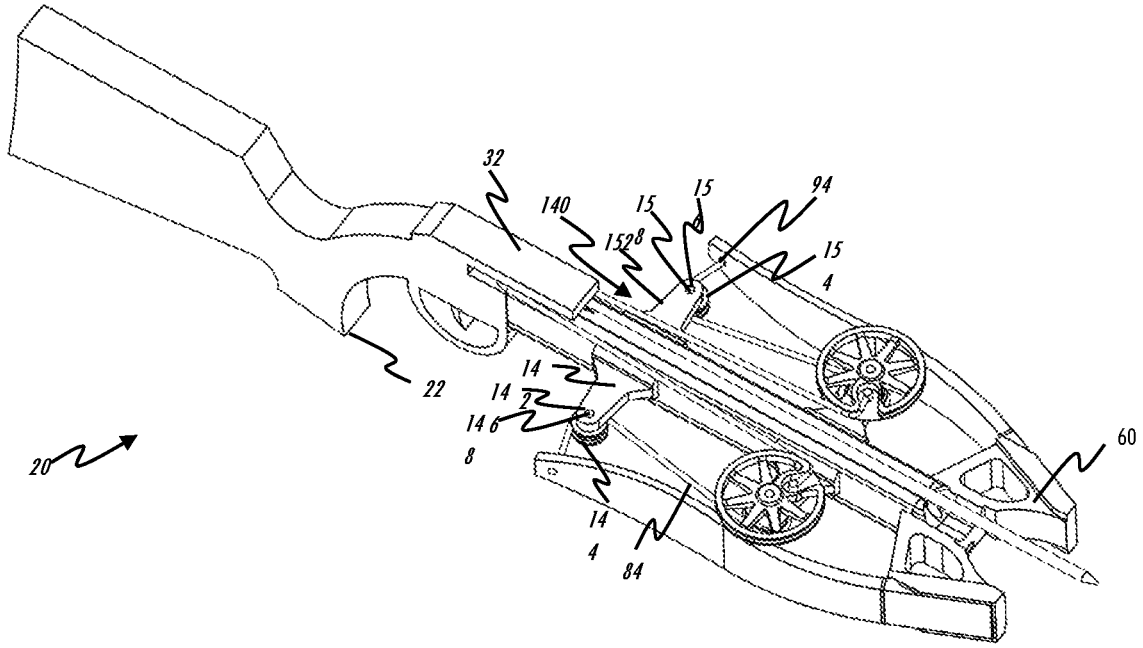
FIG. 21 is a right, top, front perspective view of the embodiment of FIG. 17 in a drawn state.

FIG. 17 is a right, top, front elevation view of another embodiment of a crossbow 20 in an undrawn state. FIG. 18 is a top view of the embodiment of FIG. 17 in a drawn state. FIG. 19 is a right side elevation view of the embodiment of FIG. 17 in a drawn state. FIG. 20 is a left, bottom, front perspective view of the embodiment of FIG. 17 in a drawn state. FIG. 21 is a top, right, front perspective view of the embodiment of FIG. 17 in a drawn state.

In this embodiment, crossbow 20 has a stock 22, a barrel 30, a fire control system 32, and a bow system 40. Bow system 40 has first limb 42 and second limb 52 joined to a riser 60. Here riser 60 is illustrated as being mounted to barrel 30. In other embodiments, riser 60 may be at least in part integrally formed with barrel 30 sharing for example a common substrate or structural components. Riser 60 provides a first pocket 62 that holds a first end 44 of first limb 42 and a second pocket 64 that holds a first end 54 of second limb 52. In embodiments, fasteners 66 and 68 such as bolts can be used to hold first ends 44 and 54 to first pocket 62 and second pocket 64. The use of fasteners 66 and 68 is exemplary and is not limiting.

Crossbow 20 of FIGS. 17-21 has a mounting system 70, a first support 72 on a first side of barrel 30 and a second support 76 on an opposite side of barrel 30. In this embodiment, mounting system 70 is positioned closer to riser 60 than to fire control system 32. This locates first winding system 80, second winding system 90 and arrow string 100 with a greater power stroke distance PSD between fire control system 32 and the point at which arrow string 100 crosses barrel 30 when crossbow 20 is in an undrawn state. This can provide an increased power stroke distance. Additionally, in embodiments this can be done while making productive use of otherwise empty space between first limb 42 and barrel 30 and between second limb 52.

The embodiment of FIGS. 17-21 is also shown with a limb string management system 140. Limb string management system 140 is mounted to barrel 30 and has a first limb string positioner 142 and a second limb string positioner 152. First limb string positioner 142 includes a first limb string guide 144 shown here in the form of a wheel about which first limb string 84 is routed between free end 46 of first limb 42 and first limb string winder 86. First limb string positioner 142 is configured to position first limb string guide 144 so that first limb string guide 144 determines, at least in part, a path of travel of first limb string 84.

In the embodiment illustrated, first limb string positioner 142 and first limb string guide 144 are configured to engage first limb string 84 so that first limb string 84 must travel along a path that is longer than a path of shortest length between free end 46 of first limb 42 and first limb string winder 86. First limb string positioner 142 may provide a pivotal mounting 146 to which first limb string guide 144 may be mounted by way of a first limb string guide pivot 148 and first limb string guide 144 may have a wheel shape with an outer surface 149 about which first limb string 84 can be positioned at least in part. Here, first limb string guide 144 is shown centrally mounted to first limb string guide pivot 148. In other embodiments, first limb string guide 144 can have other shapes and can be eccentrically mounted to first limb string guide pivot 148.

In embodiments, first limb string positioner 142 and first limb string guide 144 can be configured, oriented or positioned to direct first limb string 84 to ensure that a predetermined pattern of tension levels exists in first limb string 84 during use. In embodiments, first limb string positioner 142 and first limb string guide 144 can also be configured, oriented or positioned to configure first limb string 84 so as to reduce the amplitude of vibrations at wavelengths at which the system of first limb 42 and first limb string 84 may resonate.

In embodiments, any of first limb string positioner 142, first limb string guide 144, first limb string mounting 146 and first limb string guide pivot 148 can be adjustable between two or more positions. This can be done to allow a configuration, position or orientation change that can be used to adjust interactions between first limb string guide 144 and first limb string 84 for purposes including but not limited to ensuring that a predetermined tension level or pattern of tension levels exists in first limb string 84 during use, to reduce vibrations, or to let off or increase tension in first limb string 84 for purposes including but not limited to reducing tension during drawing and reestablishing a predetermined level of tension afterward.

As is also shown in FIGS. 19-21, second limb string positioner 152 and second limb string guide 154 are configured to engage second limb string 94 to determine, at least in part, a path of travel of second limb string 94. In the embodiment illustrated, second limb string positioner 152 and second limb string guide 154 are configured to engage second limb string 94 so that second limb string 94 must travel along a path that is longer than the path of shortest length between free end 56 of second limb 52 and second limb string winder 96. Second limb string positioner 152 may provide a second pivotal mounting 156 to which second limb string guide 154 may be mounted by way of a second limb string guide pivot 158 and second limb string guide 154 may have a wheel shape with an outer surface 159 about which second limb string 94 can be positioned at least in part. Here, second limb string guide 154 is shown centrally mounted to second limb string guide pivot 158. In other embodiments, second limb string guide 154 can have other shapes and can be eccentrically mounted to second limb string guide pivot 158.

In embodiments, second limb string positioner 152 and second limb string guide 154 can be configured, oriented or positioned to direct second limb string 94 to ensure that a predetermined pattern of tension levels exists in second limb string 94 during use. In embodiments, second limb string positioner 152 and second limb string guide 154 can also be configured, oriented or positioned to direct second limb string 94 so as to reduce the amplitude of vibrations at wavelengths at which the system of second limb 52 and second limb string 94 may resonate.

Figure 22:
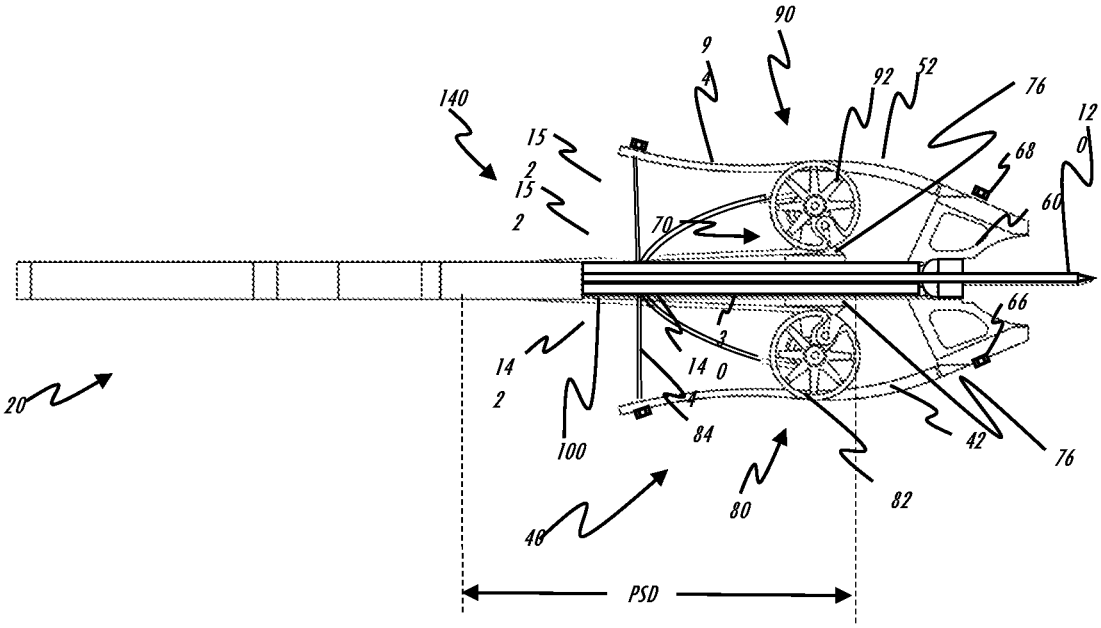
FIG. 22 is a top view of another embodiment of a crossbow in a drawn state.
Figure 23:
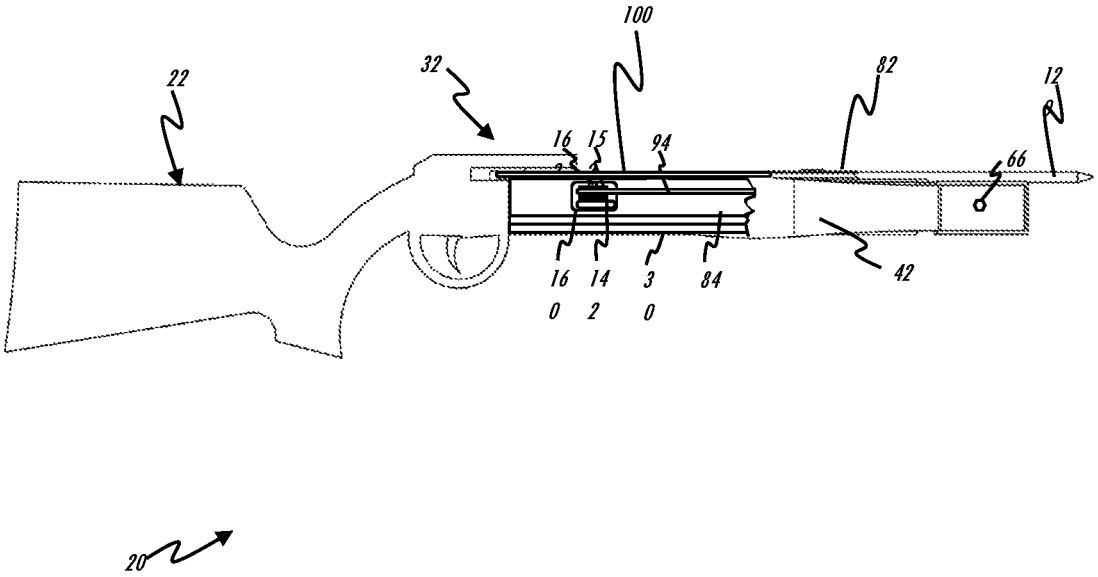
FIG. 23 is a right side view of the embodiment of FIG. 22.

FIG. 22 provides another view and a right side view of another embodiment of a crossbow 20 having a In embodiments, any of second limb string positioner 152, second limb string guide 154, second limb string mounting 156 and second limb string guide pivot 158 can be adjustable between two or more positions so as to allow a configuration, position or orientation change that can be used to adjust interactions between second limb string guide 154 and second limb string 94 for purposes including, but not limited to, ensuring that a predetermined pattern or predetermined level of tension levels exists in second limb string 94 during use, to reduce vibrations, to let off tension and restore tension in second limb string 94 or for other purposes including but not limited to reducing tension during drawing and reestablishing a predetermined level of tension afterward.

For example and without limitation, it will be appreciated that in embodiments limb strings 84 and 94 alone or in combination with other components of crossbow 20 such as first limb 42 and second limb 52 respectively, may have a range of frequencies at which limb strings 84 and 94 are capable of converting energy released during firing into string vibration or other motions of a type that create unwanted sound or other vibrations in the crossbow 20 or in the environment. Accordingly, in embodiments, first limb string positioner 142 can have first limb string guide 144 arranged to interfere with oscillation in first limb string 84 during or after firing to reduce, dampen, modulate or to convert any energy of such oscillations into a form that creates less unwanted sound or vibration. In embodiments, limb string positioners 142 and 152 and components thereof can be shaped, sized or made from materials that create interference of and partial cancellation of waves or wave energy in first limb string 84 and second limb string 94 respectively to reduce the energy available at frequencies that may create unwanted noise or vibration.

In embodiments, first limb string positioner 142 and any intermediate structure linking first limb string positioner 142 to crossbow 20, such as at barrel 30, can be manufactured or fabricated using materials that dampen, modulate or otherwise convert vibrational energy in first limb string 84.

Further, first limb string positioner 152 may be positioned and configured so that a tangency point for take-up and payout of first limb string 84 on first limb string winder 86 is controlled regardless of changes to a position of free end 46 of first limb 42 during drawing or firing. Similarly, second limb string positioner 152 may be positioned and configured so that a tangency point for take-up and payout of second limb string 94 on second limb string winder 96 is controlled regardless of changes to a position of free end 56 of second limb 52 during drawing or firing.

In embodiments, limb string management system 140 may be mounted to, formed integrally with stock 22, barrel 30 or may be joined thereto by way of an intermediate structure and does not add to the un-sprung mass of limbs 42 and 52. By mounting limb string management system 140 to a rigid structure such as barrel 30, it becomes possible for limb strings 84 and 94 direct the flexible and spring like limbs 42 and 52. For example, the embodiment shown in a top view in FIG. 22 and in a side view with a portion of limb 42 cut away, limb string management system 140 is positioned within an opening 160 in barrel 30. In this example, first positioner 142 and second positioner 152 are shown mounted to a common axle 162.

Figure 24:
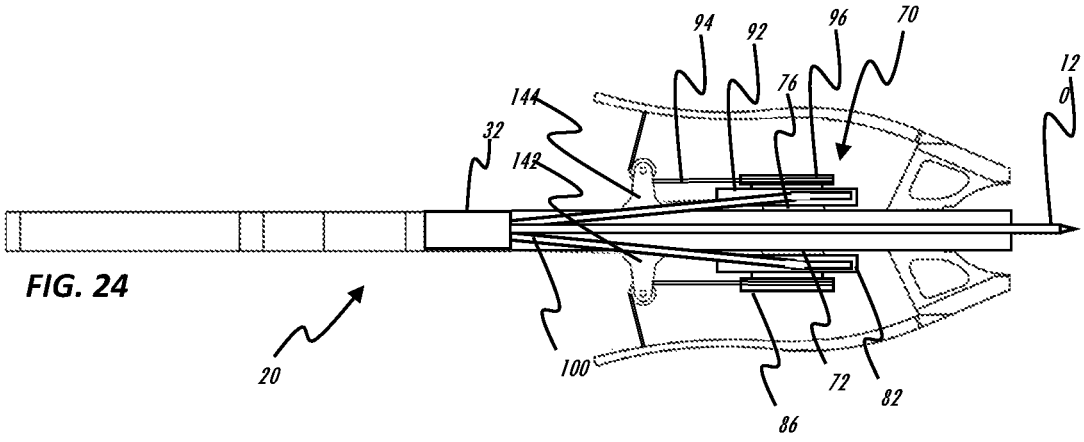
FIG. 24 is a top view of another embodiment of a crossbow in a drawn state.
Figure 25:
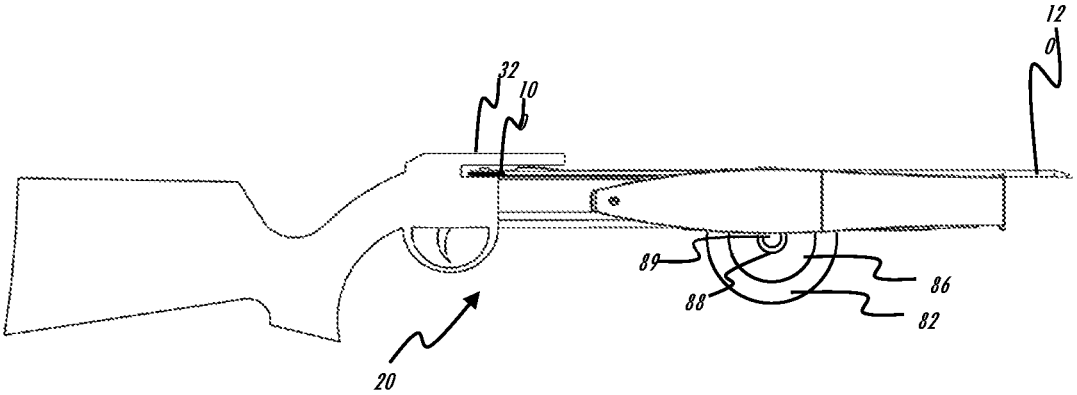
FIG. 25 is a right side view of the embodiment of FIG. 24 in a drawn state.
Figure 26:
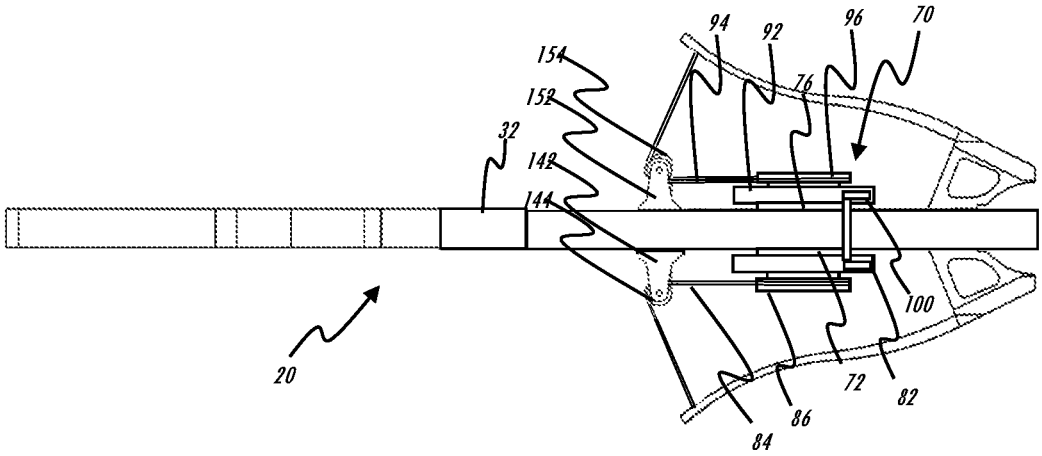
FIG. 26 is a top view of another embodiment of a crossbow in an un-drawn state.
Figure 27:
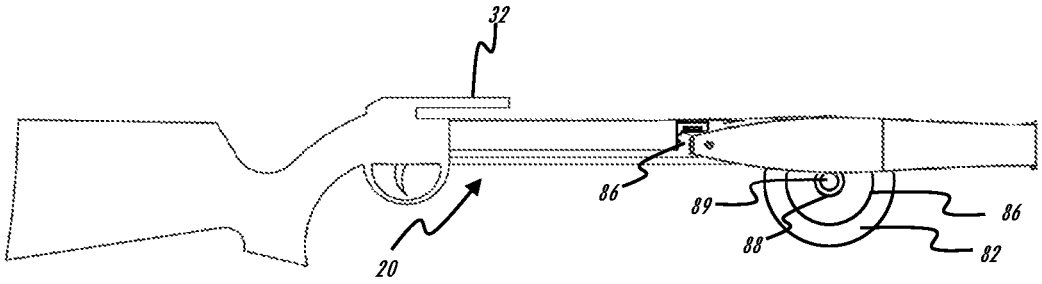
FIG. 27 is a right elevation of the embodiment of FIG. 26 in an un-drawn state.

FIG. 24 is a top view of another embodiment of a crossbow 20 in a drawn state while FIG. 25 is a right elevation view of the embodiment of FIG. 24 in a drawn state. FIG. 26 is a top view of the embodiment of FIG. 24 in the un-drawn state and FIG. 27 is a right elevation view of the embodiment of FIG. 24 in an un-drawn state. As can be seen in this embodiment, mounting system 70 provides a first mounting 72 that is configured to mount to a first winding system 80 such that first arrow string winder 82 is at an angle that is not generally parallel to a direction of travel of arrow string 100 during drawing or firing. Mounting 70 also has a second mounting 76 that is configured to mount to a second winding system 90 such that second arrow string winder 92 is not parallel to a direction of travel of arrow string 100 during drawing or firing.

This embodiment illustrates an optional and different configuration of mounting system 70, first winding system 80 and second winding system 90 in which interconnects 88 and 98 are tubular and mounting system 70 has supports 72 and 82 with a first winding system mount 74 and a second mounting 84 that take the form of axles onto which interconnect 88 and second interconnect can be mounted. Any known retention method can be used to hold interconnect 88 and second interconnect 98 onto first winding system mount 74 and second winding system mount 78, examples of which include but are not limited to: set screws, retaining rings, e-clips, nuts, pins etc.

As can be seen in FIGS. 24-27, in embodiments of this type, a crossbow 20 is provided where the rotational path about which of arrow string winders 82 and 92 wind arrow string 100 can have a reduced impact on the overall width of crossbow. In embodiments, the forward motion of arrow string 100 caused by rotation of first arrow string winder 82 and second arrow string winder 92 can be arrested when the payout of the first limb string winder 86 and second limb string winder 96 is exhausted during firing. In other embodiments, this forward motion of arrow string 100 can be arrested when first arrow string winder 82 and second arrow string winder 92 rotate to a point where movement of arrow string 100 is blocked by barrel 30. In other embodiments, other mechanisms can be used to arrest forward movement of arrow string 10.

Figure 28:
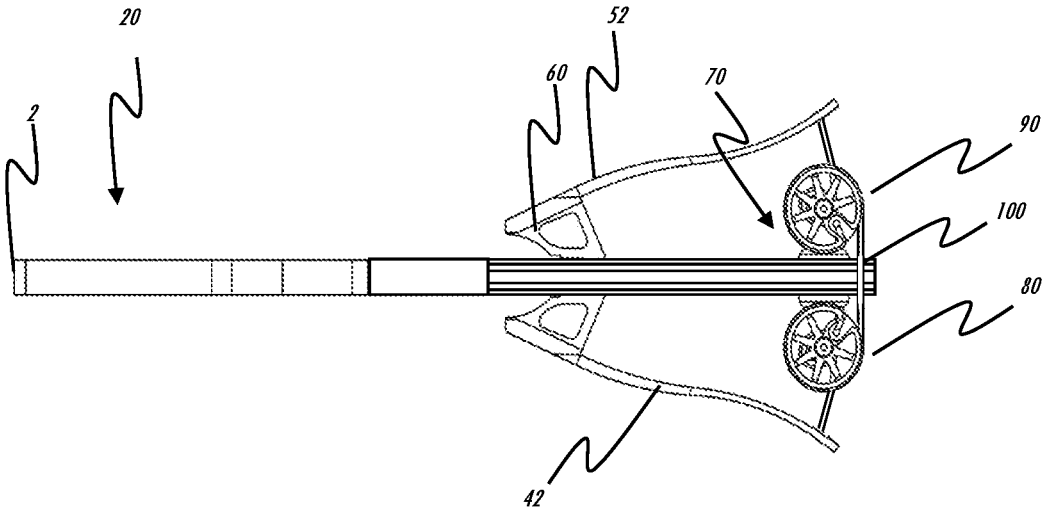
FIG. 28 is a top view of an embodiment of a crossbow with a reverse draw configuration in an undrawn state.
Figure 29:
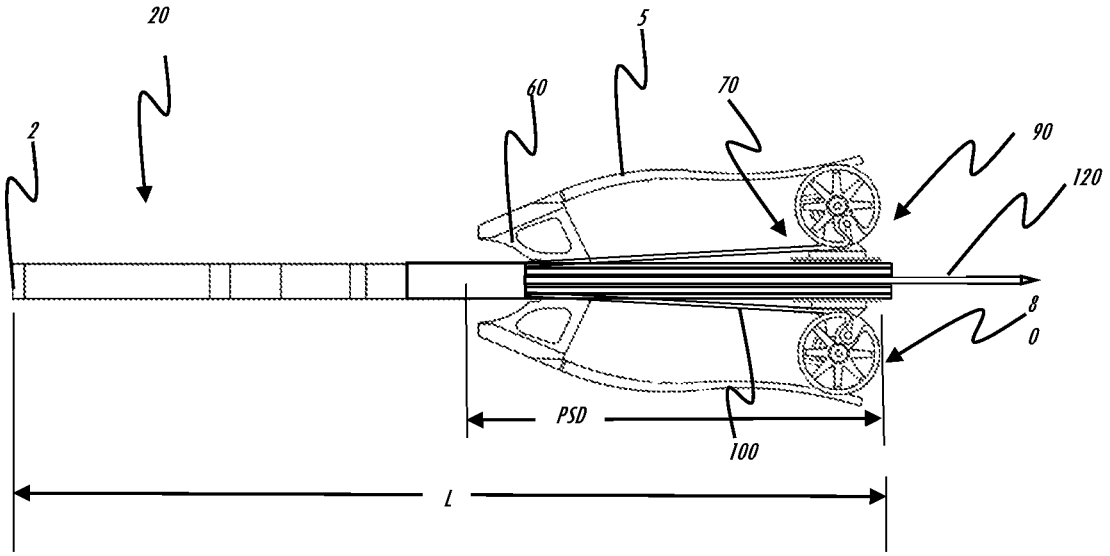
FIG. 29 is a top view of an embodiment of a crossbow with a reverse draw configuration in a drawn state.

FIG. 28 is a top view of an embodiment of a crossbow with a reverse draw configuration in an undrawn state. FIG. 29 is a top view of the crossbow 20 of FIG. 28 in a drawn state. In this embodiment, riser 60 is configured so that limbs 42 and 52 extend in a direction that is generally reversed from conventional limb configurations. In embodiments, riser 60 is positioned between a butt 26 of stock 22 and mounting system 70 with limbs 42 and 52 extending, at least in part, along a direction that is generally in parallel with barrel 30. In embodiments, riser 60 may be positioned between fire control system 32 and mounting 70.

In this embodiment, mounting 70 positions first winding system 80 and second winding system 90 so that a crossbow 20 can be provided that offers the advantage having a significant power stroke distance PSD while also maintaining a compact length L. The power stroke distance PSD may comprise at least as much as 40% of the length L of crossbow 20. Such a crossbow 20 provides portability, maneuverability, and weight advantages as compared to conventional arrangements in addition to offering many of the other advantages of crossbow 20.

In this embodiment, other advantages of a reverse configuration can be achieved without the challenges associated with mounting wheels or cams to bow limbs.

It should be appreciated that changes could be made to the embodiments described above without departing from the inventive concepts thereof. It should be understood, therefore, that any invention disclosed herein is not limited to the particular embodiments disclosed, but it is intended to cover modifications within the spirit and scope of the present invention.

What is claimed is:

1. A crossbow, comprising:

a barrel;

a fire control system; and a bow system including:

a riser positioning a first limb on a first side of the barrel and a second limb on a second side of the barrel, a first winding system joined to the first side of the barrel, the first winding system having:

a first limb string linked to a free end of the first limb and to a rotatable first limb string winder about which the first limb string can be wound, a rotatable first arrow string winder about which a first portion of an arrow string can be wound, and a first interconnect operably coupling the rotatable first limb string winder and the rotatable first arrow string winder, the first interconnect comprising a first gear train that transfers at least a portion of a first force urging rotation of the rotatable first limb string winder to urge rotation of the rotatable first arrow string winder;

a second winding system joined to the second side of the barrel, the second winding system having:

a second limb string linked to a free end of the second limb and to a rotatable second limb string winder about which the second limb string can be wound, a rotatable second arrow string winder about which a second portion of the arrow string can be wound, and a second interconnect operably coupling the rotatable second limb string winder and the rotatable second arrow string winder, the second interconnect comprising a second gear train that transfers at least a portion of a second force urging rotation of the rotatable second limb string winder to urge rotation of the rotatable second arrow string winder;

wherein the bow system is configured such that the first limb urges the rotatable first limb string winder to rotate in a manner that unwinds the first limb string from the rotatable first limb string winder and the first interconnect applies the at least the portion of the first force urging the rotatable first arrow string winder to rotate in a manner that winds the first portion of the first limb string; and wherein the bow system is configured such that the second limb urges the rotatable second limb string winder to rotate in a manner that unwinds the second limb string from the rotatable second limb string winder and the second interconnect applies the at least the portion of the second force urging the rotatable second arrow string winder to rotate in a manner that winds the second portion of the second limb string.

2. The crossbow of claim 1, further comprising a mount joined to the barrel, the mount including:

a first support with a first winding system mount adapted to receive the first winding system; and a second support with a second winding system mount adapted to receive the second winding system.

3. The crossbow of claim 2, wherein the first winding system mount provides a first inset surface in which at least one of a bearing, journal, or assembly is positioned to cooperate with the first winding system.

4. The crossbow of claim 2, wherein the second winding system mount provides a second inset surface in which at least one of a bearing, journal, or assembly is positioned to cooperate with the second winding system.

5. The crossbow of claim 1, wherein:

a length the first limb string is different than a length of a second limb string; and a difference in the length of the first limb string and the length of the second limb string provides the first limb with a first spring constant and the second limb with a second spring constant.

6. The crossbow of claim 1, wherein at least one of:

the first interconnect provides an indirect linkage between the rotatable first limb string winder and the rotatable first arrow string winder; or the second interconnect provides an indirect linkage between the rotatable second limb string winder and the rotatable second arrow string winder.

7. The crossbow of claim 1, wherein at least one of:

the first interconnect further comprises a first plurality of linkages, or the second interconnect further comprises a second plurality of linkages.

8. The crossbow of claim 1, wherein at least one of the first interconnect or the second interconnect comprises an energy storage and release system that is configured to store and release potential energy in a manner that helps to improve a consistency with which arrow string provides a pattern of force to arrow during firing.

9. The crossbow of claim 1, wherein at least one of the first interconnect or the second interconnect comprises an energy storage and release system configured to store and release potential energy in a manner that achieves at least one of consistent acceleration or velocity curves for an arrow fired by the crossbow.

10. The crossbow of claim 1, wherein the first interconnect provides a separation between a plane of rotation of the rotatable first arrow string winder and a plane of rotation of the rotatable first limb string winder that is sufficient to allow at least a portion of the first limb to move into the separation.

11. The crossbow of claim 1, wherein the first interconnect provides a separation between a plane of rotation of the rotatable first arrow string winder and a plane of rotation of the rotatable first limb string winder by means of an interconnect that is not integrally formed with at least one of the rotatable first arrow string winder or the rotatable first limb string winder.

12. The crossbow of claim 1, wherein the second interconnect provides a separation between a plane of rotation of the rotatable second arrow string winder and a plane of rotation of the rotatable second limb string winder that is sufficient to allow at least a portion of the second limb to move into the separation.

13. The crossbow of claim 1, wherein the first interconnect provides a separation between a plane of rotation of the rotatable first arrow string winder and a plane of rotation of the rotatable second limb string winder by means of an interconnect that is not integrally formed with at least one of the rotatable second arrow string winder or the rotatable second limb string winder.

14. A crossbow, comprising:

a barrel;

a first limb including a first end and a second end, the first end of the first limb coupled to the barrel;

a second limb including a first end and a second end, the first end of the second limb coupled to the barrel;

a first winding system including:

a first arrow string winder configured to receive at least a first portion of an arrow string;

a first limb string having a first end and a second end, the first end of the first limb string coupled to the second end of the first limb;

a first limb string winder configured to receive the second end of the first limb string, wherein the first limb string winder is concentric with the first arrow string winder; and a first interconnect operably coupling the first arrow string winder and the first limb string winder, wherein the first interconnect transfers a first force to the first rotatable limb string winder that is less than a second force urging rotation of the rotatable first arrow string winder; and a second winding system including:

a second arrow string winder configured to receive at least a second portion of the arrow string;

a second limb string having a first end and a second end, the first end of the second limb string coupled to the second end of the second limb;

a second limb string winder configured to receive the second end of the second limb string, wherein the second limb string winder is concentric with the second arrow string winder; and a second interconnect operably coupling the second arrow string winder and the second limb string winder, wherein the second interconnect transfers a third force to the second rotatable limb string winder that is less than a fourth force urging rotation of the rotatable second arrow string winder.

15. The crossbow of claim 14, further comprising a mount coupled to the barrel, the mount including:

a first support configured to receive the first winding system; and a second support configured to receive the second winding system.

16. The crossbow of claim 15, wherein:

the first support has a first receptacle for receiving the first interconnect; and the second support has a second receptacle for receiving the second interconnect.

17. The crossbow of claim 14, wherein at least one of:

the first interconnect comprises at least one of a gear train, transmission, or linkage operably coupling the rotatable first limb string winder and the rotatable first arrow string winder; or the second interconnect comprises at least one of a gear train, transmission, or linkage operably coupling the rotatable second limb string winder and the rotatable second arrow string winder.

18. A crossbow, comprising:

a barrel;

a first limb including a first end and a second end, the first end of the first limb coupled to the barrel;

a second limb including a first end and a second end, the first end of the second limb coupled to the barrel;

a mount coupled to the barrel, the mount including:

a first support having a first side and a second side; and a second support having a first side and a second side;

a first winding system operably coupled to the first support, the first winding system including:

a first arrow string winder disposed on the first side of the first support and configured to receive at least a first portion of an arrow string;

a first limb string having a first end and a second end, the first end of the first limb string coupled to the second end of the first limb;

a first limb string winder disposed on the second side of the first support and configured to receive the second end of the first limb string; and a first interconnect extending at least partially through the first support, the first interconnect indirectly coupling the first arrow string winder and the first limb string winder; and a second winding system operably coupled to the second support, the second winding system including:

a second arrow string winder disposed on the first side of the second support and configured to receive at least a second portion of the arrow string;

a second limb string having a first end and a second end, the first end of the second limb string coupled to the second end of the second limb;

a second limb string winder disposed on the second side of the second support and configured to receive the second end of the second limb string; and a second interconnect extending at least partially through the second support, the second interconnect indirectly coupling the second arrow string winder and the second limb string winder.

19. The crossbow of claim 18, wherein at least one of:

an axis of rotation of the first arrow string winder is concentric with an axis of rotation of the first limb string winder or the axis of rotation of the first arrow string winder is non-concentric with the axis of rotation of the first limb string winder; or the axis of rotation of the second arrow string winder is concentric with an axis of rotation of the second limb string winder or the axis of rotation of the second arrow string winder is non-concentric with the axis of rotation of the second limb string winder.

20. The crossbow of claim 18, wherein:

the first arrow string winder provides rotational movement of the first limb string winder, via the first interconnect, during winding and unwinding of the first portion of the arrow string from the first arrow string winder; and the second arrow string winder provides rotational movement of the second limb string winder, via the second interconnect, during winding and unwinding of the second portion of the arrow string from the second arrow string winder.

* * * * *